US010442058B2

(12) United States Patent
Wang

(10) Patent No.: US 10,442,058 B2
(45) **Date of Patent: *Oct. 15, 2019**

(54) AUXILIARY WOODWORKING COMPONENT

(71) Applicant: MICRO JIG, INC., Winter Springs, FL (US)

(72) Inventor: Henry Wang, Winter Park, FL (US)

( * ) Notice: Subject to any disclaimer, the term of this patent is extended or adjusted under 35 U.S.C. 154(b) by 26 days.

This patent is subject to a terminal disclaimer.

(21) Appl. No.: 15/788,311

(22) Filed: Oct. 19, 2017

(65) Prior Publication Data

US 2018/0036867 A1 Feb. 8, 2018

Related U.S. Application Data

(63) Continuation-in-part of application No. 14/728,154, filed on Jun. 2, 2015, now Pat. No. 10,099,398.

(60) Provisional application No. 62/007,017, filed on Jun. 3, 2014.

(51) Int. Cl.

| | |
|---|---|
| ***B25B 5/10*** | (2006.01) |
| ***B27B 27/10*** | (2006.01) |
| ***B25B 5/16*** | (2006.01) |
| ***B25B 5/00*** | (2006.01) |

(52) U.S. Cl.

CPC ..... *B25B 5/102* (2013.01); *B25B 5/003* (2013.01); *B25B 5/006* (2013.01); *B25B 5/163* (2013.01); *B27B 27/10* (2013.01)

(58) Field of Classification Search

CPC ..... B25B 5/003; B25B 5/006; B25B 5/102; B25B 5/163; B27B 27/10

USPC ..... 269/249

See application file for complete search history.

(56) References Cited

U.S. PATENT DOCUMENTS

| | | | | |
|---|---|---|---|---|
| 1,026,475 | A | 5/1912 | Tarbuck | |
| 1,793,560 | A | 2/1931 | Schmieder | |
| 2,642,905 | A | 6/1953 | Hewat | |
| 3,052,462 | A * | 9/1962 | Butler | B25B 5/101 269/249 |
| 3,664,654 | A | 5/1972 | Manville | |
| 3,697,046 | A | 10/1972 | Sur | |

(Continued)

FOREIGN PATENT DOCUMENTS

| | | |
|---|---|---|
| DE | 9200535 | 12/1993 |
| GB | 2339402 | 7/1998 |
| WO | 1997043094 | 11/1997 |

OTHER PUBLICATIONS

"The Rockler T-Track Table Top", www.newwoodworker.com/reviews/rcklrttrktbletoprvu.html; Aug. 26, 2013.

*Primary Examiner* — George B Nguyen

(74) *Attorney, Agent, or Firm* — Beusse, Wolter, Sanks & Maier PLLC; Robert L. Wolter

(57) ABSTRACT

Embodiments of an auxiliary woodworking component may comprise a board having a first side and a second side and a peripheral side edge defining a shape of the board. At least one dovetail shaped first groove is in the first side of the board and having an opening at the peripheral side edge of the board and the at least one first groove extends in a first direction. At least one dovetail shaped second groove is in the first side of the board and having an opening at the peripheral side edge of the board and the at least one second groove extends in a second direction that is different than the first direction. Each of the first and second dovetail shaped grooves is trackless.

14 Claims, 21 Drawing Sheets

(56) References Cited

U.S. PATENT DOCUMENTS

| | | | | | |
|---|---|---|---|---|---|
| 4,753,425 | A | | 6/1988 | Yang | |
| 4,805,888 | A | * | 2/1989 | Bishop | B23Q 1/5468 269/235 |
| 4,861,011 | A | | 8/1989 | Varga | |
| 4,867,427 | A | | 9/1989 | Cunningham | |
| 4,962,918 | A | | 10/1990 | Yang | |
| 5,009,134 | A | | 4/1991 | Sorensen et al. | |
| 5,015,421 | A | | 5/1991 | Messner | |
| 5,018,562 | A | * | 5/1991 | Adams | B27B 27/10 144/253.1 |
| 5,135,209 | A | | 8/1992 | Penny | |
| 5,181,702 | A | | 1/1993 | Pettigrew | |
| 5,190,271 | A | | 3/1993 | Otterbein, II | |
| 5,305,992 | A | * | 4/1994 | Kish | B23Q 1/035 269/228 |
| 5,405,124 | A | | 4/1995 | Mayer | |
| 5,730,434 | A | | 3/1998 | Schoene | |
| 5,768,966 | A | * | 6/1998 | Duginske | B27B 25/10 144/253.1 |
| 6,244,582 | B1 | * | 6/2001 | Marcolina | B25B 5/109 269/219 |
| 6,451,070 | B1 | | 9/2002 | Kent | |
| 6,453,643 | B1 | | 9/2002 | Buscherini | |
| 6,505,391 | B1 | | 1/2003 | Schneider | |
| 6,568,667 | B1 | | 5/2003 | Hall | |
| 6,860,475 | B2 | | 3/2005 | Wong | |
| 6,889,968 | B1 | | 5/2005 | Wong | |
| 6,935,628 | B1 | * | 8/2005 | Conversa | B25B 5/061 269/147 |
| 7,000,519 | B1 | * | 2/2006 | Weinstein | B25B 5/003 144/287 |
| 7,040,609 | B1 | | 5/2006 | Liou | |
| 7,114,714 | B2 | | 10/2006 | Wong | |
| 7,415,912 | B2 | | 8/2008 | Tyler | |
| 8,020,840 | B2 | | 9/2011 | Hall, Jr. | |
| 8,220,374 | B2 | * | 7/2012 | Wang | B27B 27/08 83/435.15 |
| 8,632,240 | B2 | | 1/2014 | Tang | |
| 9,151,422 | B2 | | 10/2015 | Kayacik | |
| 9,216,485 | B2 | | 12/2015 | Huang | |
| 10,099,398 | B2 | * | 10/2018 | Wang | B27B 27/10 |
| 2004/0245692 | A1 | | 12/2004 | Brass | |

* cited by examiner

AUXILIARY WOODWORKING COMPONENT

CROSS-REFERENCE TO RELATED APPLICATIONS

This application is a continuation in part of U.S. application Ser. No. 14/728,154 filed Jun. 2, 2015 and claims the benefit of U.S. Provisional Application No. 62/007,017 filed Jun. 3, 2014, all of which are incorporated herein by reference in their entirety.

BACKGROUND OF THE INVENTION

This invention relates generally to the field of clamping devices used to temporarily secure together two components. More specifically, the invention pertains to clamps that are used to provide additional work surfaces to woodworking apparatuses such as cutting apparatuses or woodworking benches.

With respect to woodworking apparatuses such as cutting devices (i.e., table saws, routers and band saws), clamps may be used to secure an auxiliary fence to an existing machine fence to provide additional surface area to support work pieces for cutting or to provide a sacrificial fence. Similarly, clamps may be used to affix wood boards to benches to increase working area space. Such auxiliary fences or boards are typically configured so the clamps engage these components and the woodworking apparatus in a manner to provide a flush and/or clear working surface.

Prior art auxiliary fences often include extruded metal (aluminum) members; however, these components are limited in size because of manufacturing cost and weight. In addition, the channels for receiving clamps extend in only one direction. That is, the extruded metal fences cannot be manufactured to include channels in multiple directions. Accordingly, woodworking enthusiasts and professionals often use wood boards as auxiliary or sacrificial fences that are adapted to receive clamps so that a flush work surface is available. More specifically, channels may be formed along edges of the board to receive a clamp post; however, the boards have a height dimension similar to that of the fence for the cutting tool and do not function well with larger wooden work pieces to be cut.

Alternatively, T-shaped grooves or channels have been formed on one side of the board to receive a T-shaped clamping post of a clamp, but the cross-sectional dimensions of these channels are not standardized, and the end users have difficulties in cutting the properly sized grooves to receive T-shaped clamping posts of a clamp. In addition, the T-shaped channels if cut too deep may compromise the structural integrity of the work surface. If cut too shallow, the T-shaped channels form thin strips of wood on the clamp side, which strips can readily break thereby comprising the attachment of the auxiliary fence to the machine fence of the woodworking apparatus.

Embodiments of a multi-purpose utility clamp may include a component engagement member having a clamp head and a handle. A guide arm is operatively connected to the component engagement member at a first end of the guide arm. A first post is operatively connected to a second end of the guide arm to move linearly relative to the guide arm. A second post at an end of the support post is disposed generally perpendicular to the first post and has a first end connected to the first post and a second end, distal the first end, and the second end is disposed opposite the clamping head. The second post has a generally trapezoidal cross-sectional shape along a length thereof between the first end and the second end, and the second post is configured to be inserted into a channel having a corresponding trapezoidal shape and formed in an auxiliary component to be clamped to another component.

In an embodiment, the second post has a front surface facing the clamp head and a back surface opposite and generally parallel to the front surface, wherein the back surface is wider than the front surface. First and second opposite side surfaces extending from the back surface to the front surface are disposed at an angle of about 76° relative to the back surface, or at an angle of about 14° relative to a reference line that is perpendicular to the back surface.

Embodiments of the invention may also include a multi-purpose utility clamp in combination with an auxiliary wooden component configured to be clamped to a woodworking apparatus. The clamp may comprise a component engagement member including a clamp head and a handle. A guide arm is operatively connected to the component engagement member at a first end of the guide arm. A first post is operatively connected to a second end of the guide arm to move linearly relative to the guide arm; and, a second post at an end of the first post is disposed generally perpendicular to the first post and has a first end connected to the first post and a second end, distal the first end, and the second end is disposed opposite the clamping head. The second post has a generally trapezoidal cross-sectional shape along a length thereof between the first end and the second end, and the second post is configured to be inserted into a channel having a corresponding trapezoidal shape and formed in an auxiliary component to be clamped to another component. The wooden auxiliary component includes at least one channel formed in the wooden component, and the at least one channel has a cross-section trapezoidal corresponding to the trapezoidal shape of the second post.

BRIEF DESCRIPTION OF THE DRAWINGS

These and other advantages of the invention will become more apparent from the following description in view of the drawings. Similar structures illustrated in more than one figure are numbered consistently among the drawings.

DETAILED DESCRIPTION OF THE INVENTION

In describing particular features of different embodiments of the present invention, number references will be utilized in relation to the figures accompanying the specification. Similar or identical number references in different figures may be utilized to indicate similar or identical components among different embodiments of the present invention.

It is to be noted that the terms "first," "second," and the like as used herein do not denote any order, quantity, or importance, but rather are used to distinguish one element from another. The terms "a" and "an" do not denote a limitation of quantity, but rather denote the presence of at least one of the referenced item. Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. As a non-limiting example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 7. It is to be noted that all ranges disclosed within this specification are inclusive and are independently combinable.

Figure 1:
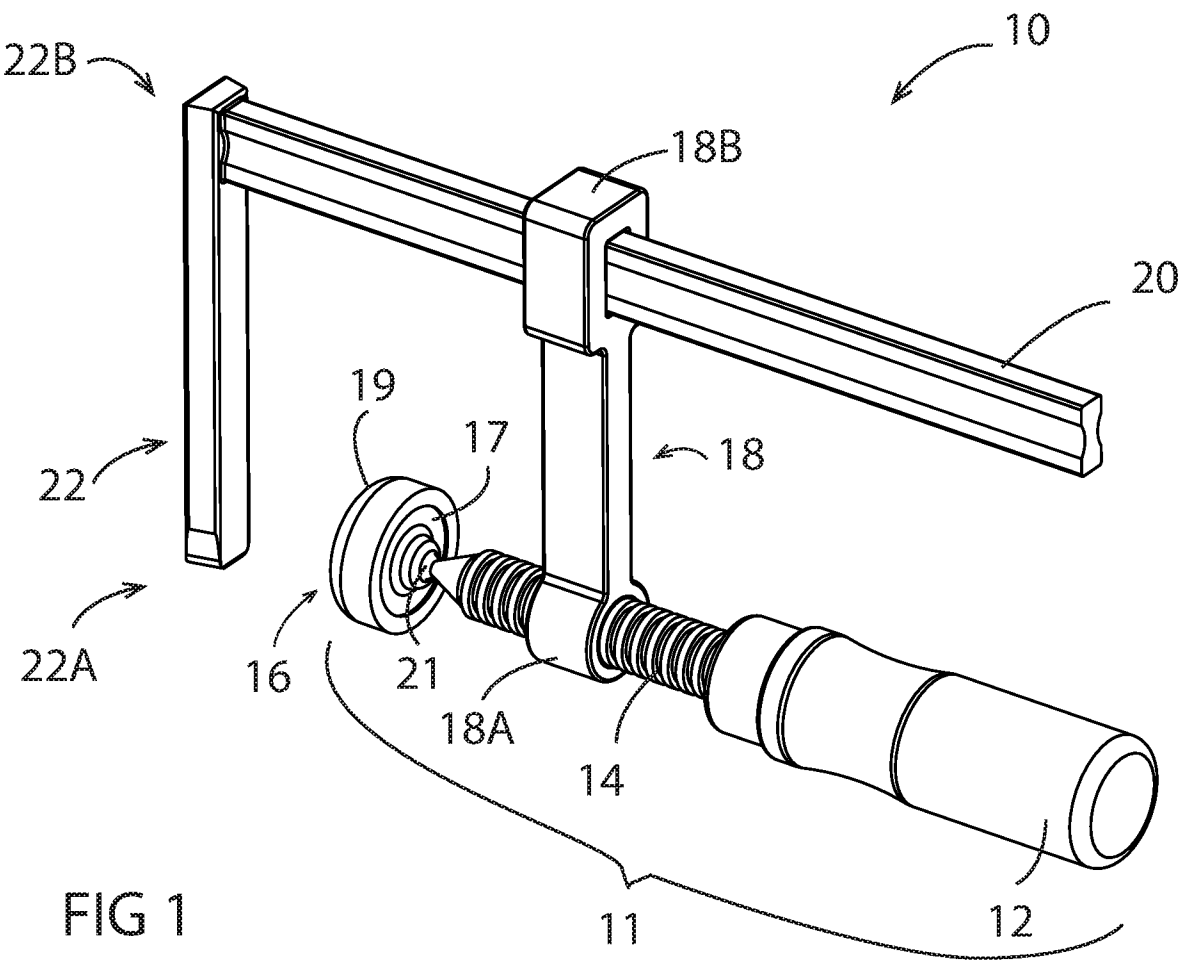
FIG. 1 is a perspective view of a clamp in accordance with the present invention.

In reference to FIG. 1 a clamp 10 is illustrated and includes a component engagement member 11 that may further include a handle 12 affixed to one end of a threaded shaft 14 and a clamp head 16 pivotally attached to the other end of the other threaded shaft 14. In an embodiment, the clamp head 16 may include disc 17 fabricated from a metal alloy such as stainless steel and a cap member 19 fitted over the disc member 17. The cap member 19 may be fabricated from a natural or synthetic rubber, or a plastic material. Embodiments may include the head clamp 16 pivotally interconnected to the shaft 14. By way of example, a ball and socket type joint 21 may be provided so the clamp head 16 pivots relative to the shaft 14.

A guide arm 18 is provided in threaded engagement with the threaded shaft 14 at a first end 18A thereof and supports a first post 20 at a second end 18B. The first post 20 is connected in linear sliding engagement with the guide arm 18 to accommodate different thicknesses of items to be claimed together. A second post 22 (also referred to herein as "clamping post") is attached to the first post 20 at preferably, substantially 90° and extends toward the clamp head 16. The term "substantially" or "generally" perpendicular means within ±5° of 90°, and preferably within ±2° of 90°. The first post 20 and second post 22 may be separate parts that are welded together, or other fastening mechanisms may be used to secure the posts, 20, 22 together. Alternatively, the first and second posts 20, 22 or may be forged or made as a single integral component.

As will be explained in more detail below, when clamping to components together, the second post 22 is inserted into a channel of an auxiliary (or second) component to be clamped to a woodworking apparatus. The second or auxiliary component, which may be a wooden member with one or more channels, is positioned against a surface, such as a fence of a table or table saw or router table (or a first component), and the clamp head 16 is positioned against the first component by sliding the first post 20 along the guide arm 18 away from the first component, or sliding the engagement member 11, including the clamp head 16 toward the first and second components. The handle 12 is then rotated thereby rotating the threaded shaft 14 so the clamp head 16 moves linearly toward the second post 22 securing the two components together.

The threaded shaft 14 acts as a gear mechanism operatively connected to the guide arm 18 to facilitate relative movement of the clamp head 16, guide arm 18 and clamping post 22 to clamp to components together. While embodiments described herein includes the guide arm 18 attached in threaded engagement with the threaded shaft 14 for adjustment of the second post 22 relative to the clamp head 16, the invention is not so limited, and may include other gear mechanisms or other clamping mechanisms. For example, the guide arm 18 may be operatively connected to a handle that has lock and ratcheting mechanism to position the second post 22 relative to the clamp head 16 such as incorporated in the Quick Clamp sold by Festool. In addition, the term handle is intended to cover any type of gripping member that allows manipulation of the clamp 10, such as a knob. To that end, the invention is not limited to a rotatable handle connected to a threaded shaft. In addition, the invention is not limited to the embodiment shown and described herein wherein the support post 20 is in sliding engagement with the guide arm 18. The invention is intended to cover any clamp, with the below-described clamping post member with a cross-sectional trapezoidal shaped post member corresponding to a dovetail shape of a channel formed in an auxiliary fence, bench or work piece.

The inventor of the subject invention has innovatively developed the clamp 10 including a clamping post (second post 22) that has a generally trapezoidal or dovetail cross-sectional configuration. In an embodiment, the trapezoidal configuration extends the length of the clamping post 22, or is disposed at least at or toward a first end 22A of the clamping post 22, or the trapezoidal configuration is disposed along a length of the second post 22 between the first end 22A and second end 22B thereof, and the trapezoidal shape does not have to necessarily extend an entire length of the second post 22. In addition, the second post 22 may be slightly narrower at the tip of the first end 22A so the second post 22 can be readily inserted into a channel on the second component. One or more dovetail channels or channels are preferably formed in the auxiliary component having the dimensions of a dovetail router bit that is commonly and widely used by woodworking enthusiasts and professionals. In this manner, end users can readily form dovetail channels in which the clamping post 22 snugly fits for clamping. Moreover, although the invention is described in reference to use with woodworking apparatuses, the invention is not so limited. The inventive clamp may be used with a variety of different fabricating tools and could be used with, for example, metal fabricating tools. In addition, the second auxiliary component may be wooden or composed of other materials such as metallic materials.

Figure 2:
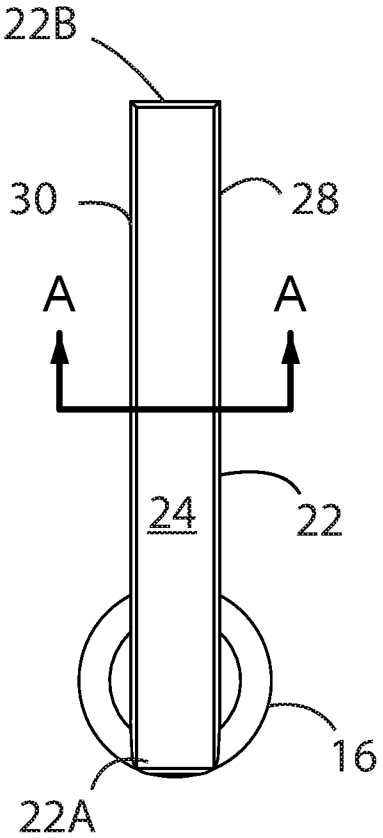
FIG. 2 is an end view of the clamp of FIG. 1.
Figure 2A:
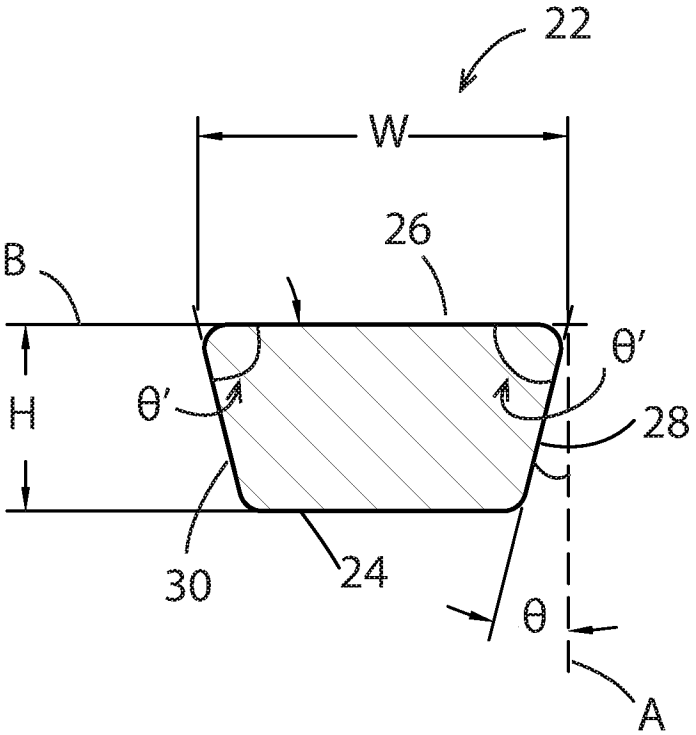
FIG. 2A is a cross-sectional view taken along line A-A of FIG. 2, illustrating the cross-sectional dovetail shape of a clamping post of the clamp.
Figures 3, 3A:
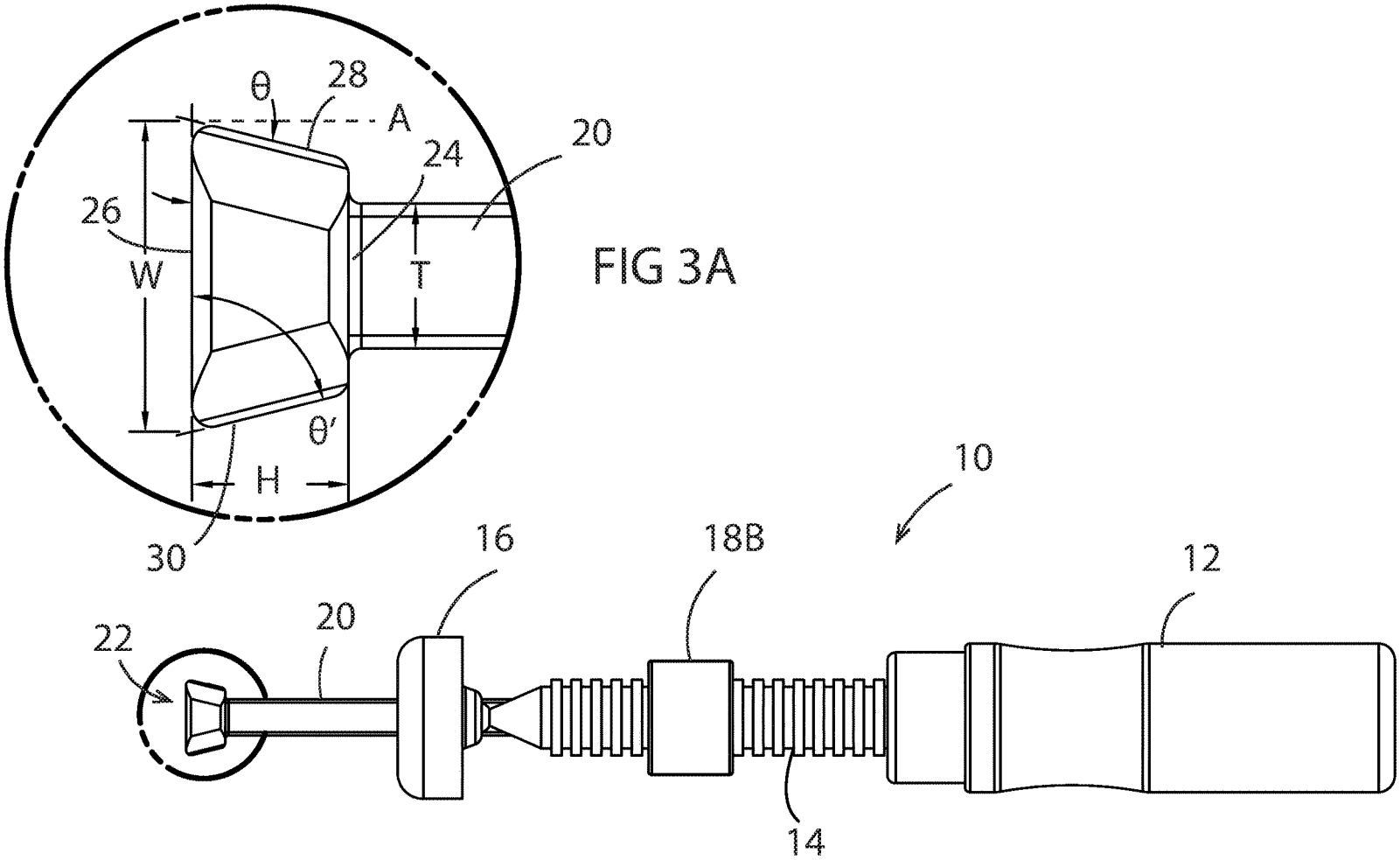
FIG. 3 is a bottom view of the fence clamp of FIG. 1.
FIG. 3A is an exploded view of the end of the clamping post of FIG. 3.

In reference to FIGS. 2 and 2A, the second post or clamping post 22 is illustrated in more detail. More specifically, as shown in FIG. 2A the post 22 has a trapezoidal or dovetail cross-sectional shape including tapered side surfaces 28, 30 extending between end surfaces 24, 26. The end surfaces 24, 26 include a front surface 24 that faces the clamp head 16 and a back surface 26. The back surface 26 is wider than the front surface 24 so the side surfaces 28, 30 taper inward toward the front surface 24. These tapered surfaces 28, 30 may extend from a first end 22A to a second end 22B of the clamping post 22. In a preferred embodiment, the side surfaces 28, 30 are tapered at an angle θ from about 13.5° to about 14.5° and preferably about 14° as measured from dashed reference line A of FIG. 2A, which is perpendicular to the back surface 26; or, the side surfaces 28, 30 are tapered at an angle θ' from about 75.5° to about 76.5°, and preferably about 76° as measured from back surface 26 to either side surface 28 or 30 as shown FIG. 2A. As shown in FIGS. 3 and 3A, the first end 22A of the clamping post 22 A that initially is inserted in a dovetail channel is similarly dimensioned. That is, the side surfaces are tapered at an angle of about 14° from the surface 26, which engages a component for clamping, to the opposite parallel surface 24.

Again with respect to FIGS. 2A and 3A, the clamping post 22 may have a width dimension "W" of about 0.5 inches and preferably about 0.481 inches, and a height dimension "H" of about 0.240 inches, and preferably about 0.243 inches; however, embodiments of the invention are not limited to these width "W" and height "H" dimensions. Nor is the invention limited to the above-described angles. These dimensions and angles may vary according to the corresponding dimensions of a channel, within which the clamping post 22 is inserted for fixing an auxiliary work piece to a woodworking apparatus.

Figure 4:
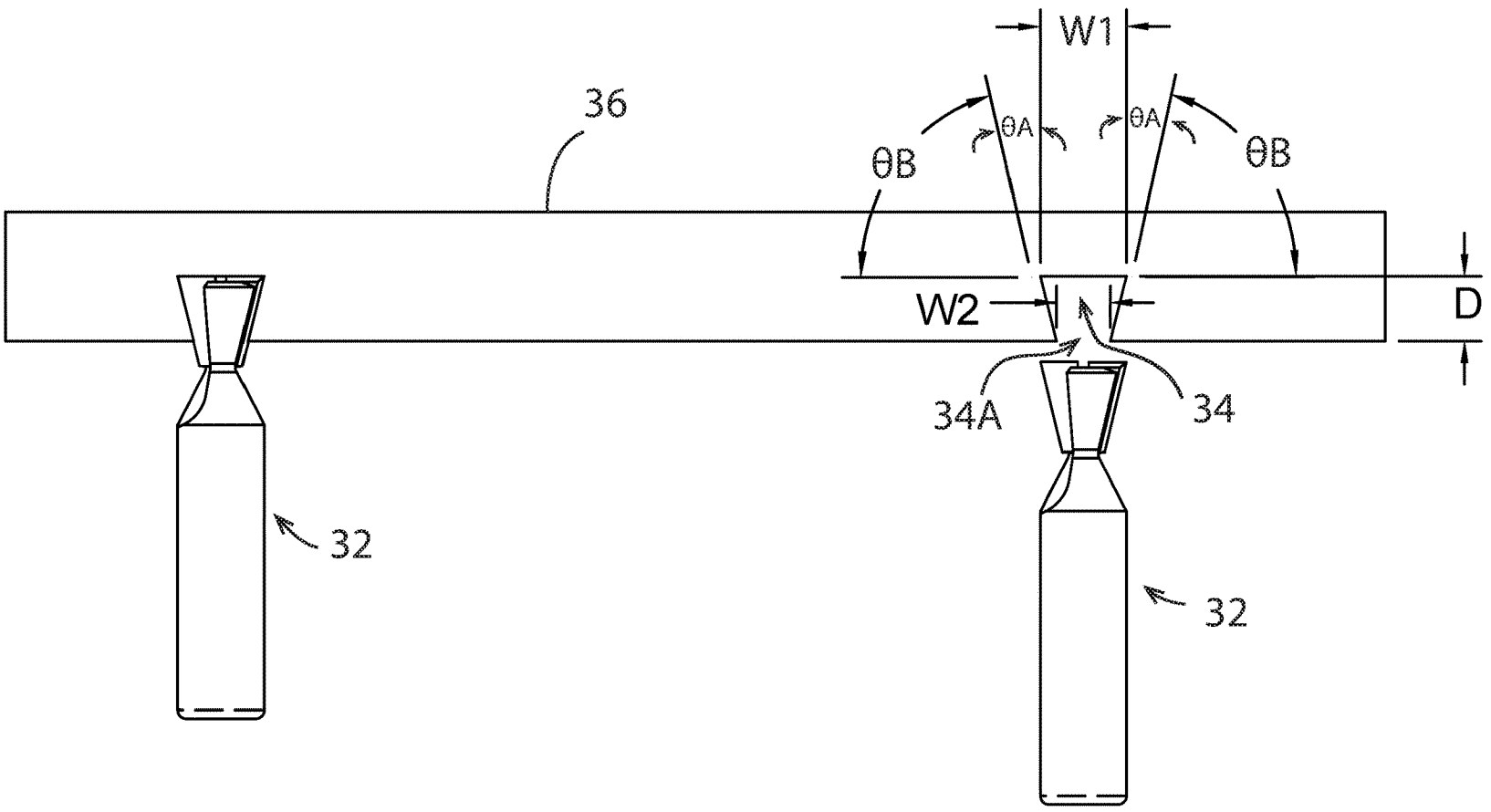
FIG. 4 is an elevational view of an accessory with a dovetail shaped channel cut for receiving the clamping post of the clamp.

With respect to FIG. 4 router bits 32 are shown in connection with a work piece 36 and a channel 34 formed therein corresponding to the router bit 32. The router bit 32 shown in FIG. 4 is preferably a widely used bit with, for example, a ½" outside diameter and 14° taper. In reference to FIGS. 2A and 4, the dimensions of the post clamp 22 are slightly smaller than that of the channel 34 formed in the auxiliary wood part 36, so the clamping post 22 snugly fits therein for clamping. By way of example, a channel 34 using the above described ½" router bit may have a width "W1" that is about 0.500 inches at its widest that tapers to a width "W2" at an opening 34A of the channel 34. In addition, the channel 34 may have a depth dimension "D" of about 0.375 inches. In a preferred embodiment, the height dimension "H" of FIG. 2A, is less than the depth dimension "D" of FIG. 4. The angles θA are about 14°, and angles θB are about 76°. In this manner, when the clamp 10 is fixed to an auxiliary component and the woodworking apparatus, the side surfaces 28, 30 engage the inclined surfaces of the channel 34.

Figure 5:
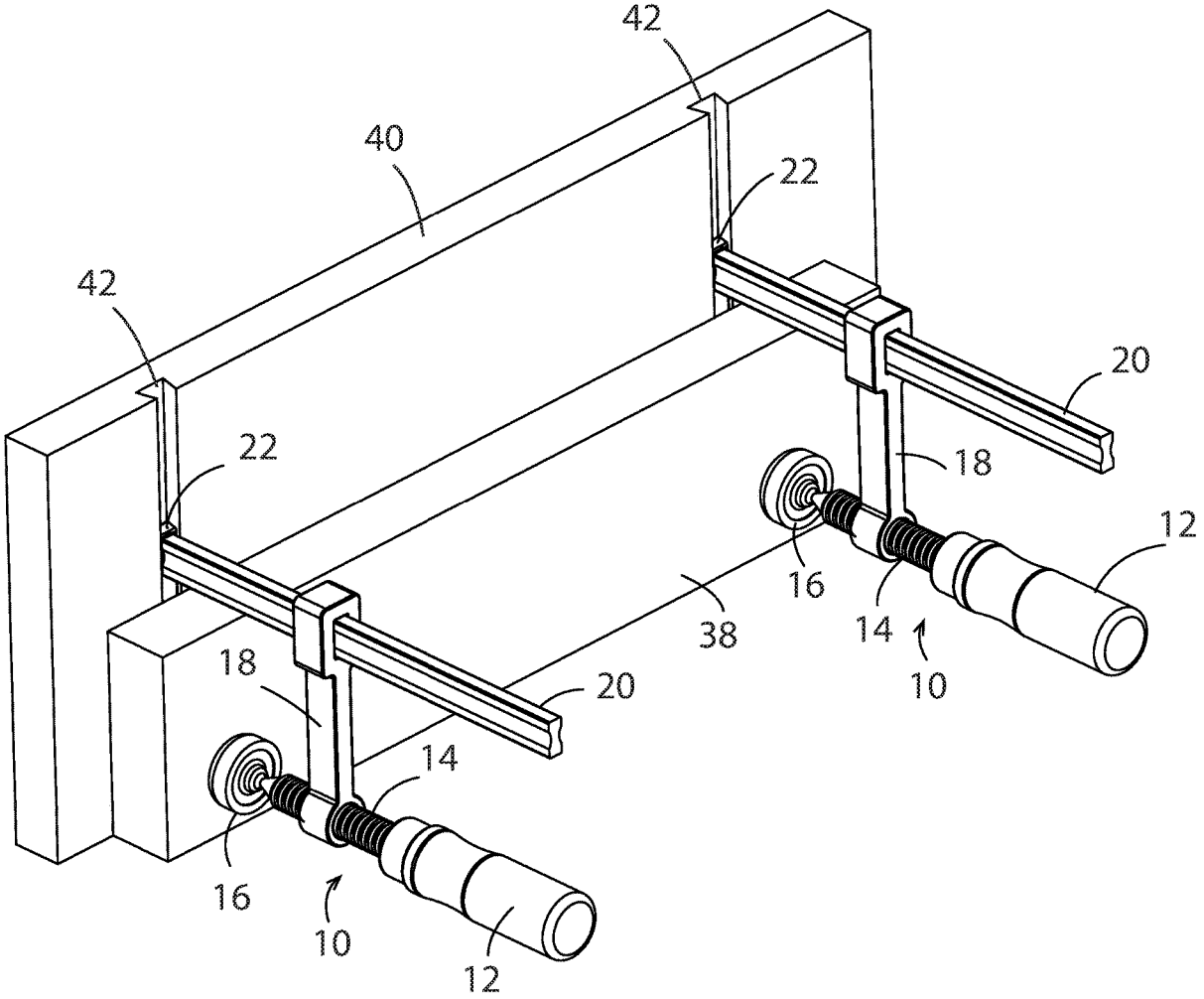
FIG. 5 is a perspective view of auxiliary fence affixed to a machine fence of a woodworking cutting device using an embodiment of the inventive clamp.
Figure 7:
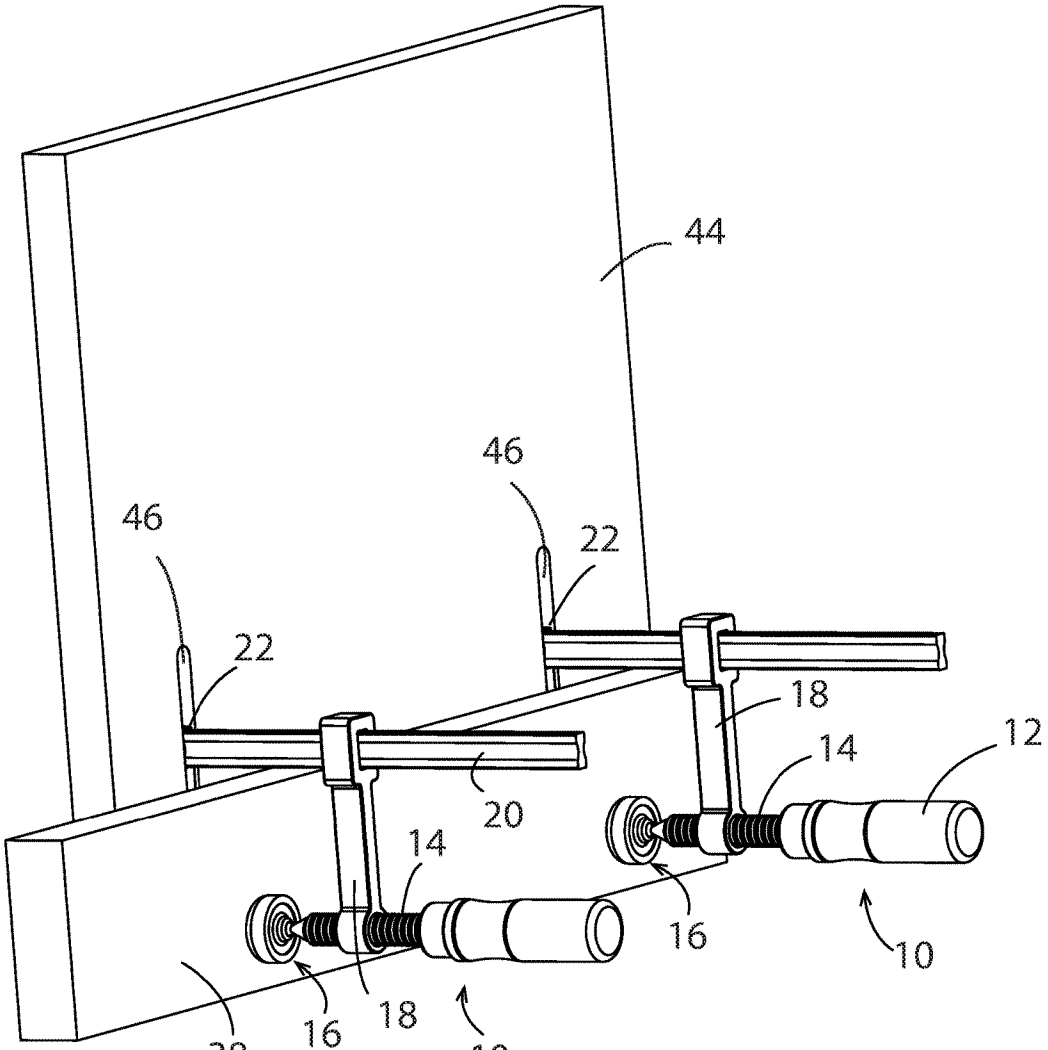
FIG. 7 is a perspective view of a larger auxiliary fence, relative to the auxiliary fence of FIG. 6, affixed to a machine fence of a woodworking cutting apparatus.

With respect to FIG. 5, the clamps 10 are shown in connection with a fence 38 and auxiliary fence 40 for a wood cutting apparatus. More specifically, the auxiliary fence 40 includes dovetail-shaped (or trapezoidal-shaped) channels 42 that extend the height of the auxiliary fence 40. In practice, the auxiliary fence 40 is positioned against the fence 38, and the clamping posts 22 of the clamps 10 are inserted into channels 42 and slid downward and adjacent to the fence 38. The engagement member 11, including the clamp head 16, is pushed toward the fence 38 so the head 16 abuts the fence 38 and the handle 12 is then rotated until the auxiliary fence 40 and fence 38 are firmly clamped together. In this manner, taller auxiliary or sacrificial fences may be used for larger work pieces to be cut. To that end, and with respect to FIG. 7, a taller auxiliary fence 44 with channels 46 may be clamped to fence 38 to serve as a support for re-sawing performed on a band saw, or on a table saw for supporting a raised panel. As further shown, the channels 46, and the channels shown in other embodiments, disclosed herein, do not have to extend an entire length, width or other dimension of the second component or auxiliary component 44. In the embodiment of FIG. 7, the second end 22B of the second post 22 may be inserted into the channel 44 and slid into position of clamping. Accordingly, second post 22 and first post 20 should be dimensioned to fit within the channel 44.

Figures 5A, 5B:
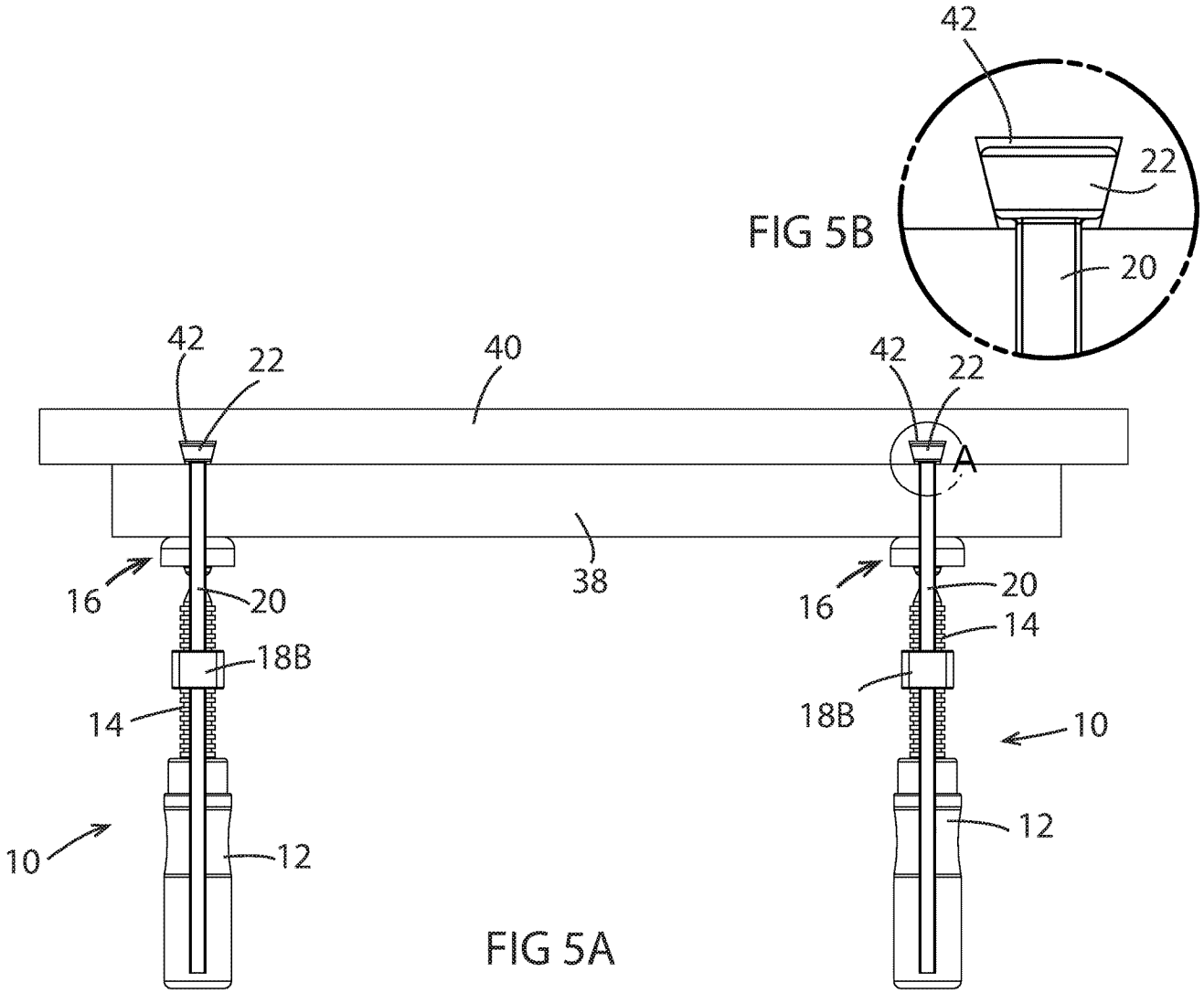
FIG. 5A is a top view of the auxiliary fence and machine fence of FIG. 5.
FIG. 5B is detail view illustrating the dovetail shaped clamping post in the dovetail channel of the auxiliary fence of FIG. 5A.

As shown in more detail in FIGS. 5A and 5B, the trapezoidal shape of the clamping post 22 corresponds to the dovetail shape of channels 42 so the clamping posts 22 remain within the channels 42 when the two components 38, 40 are tightened together. Moreover, forming the dovetail channels at such an angle does not create the above referenced thin strips of wood as compared to the T-shaped channels. The sides of the channels 42 provide sufficient support to the clamping posts 22, so the posts 22 remain in the channels during clamping and operation of the woodworking apparatus.

Figure 8:
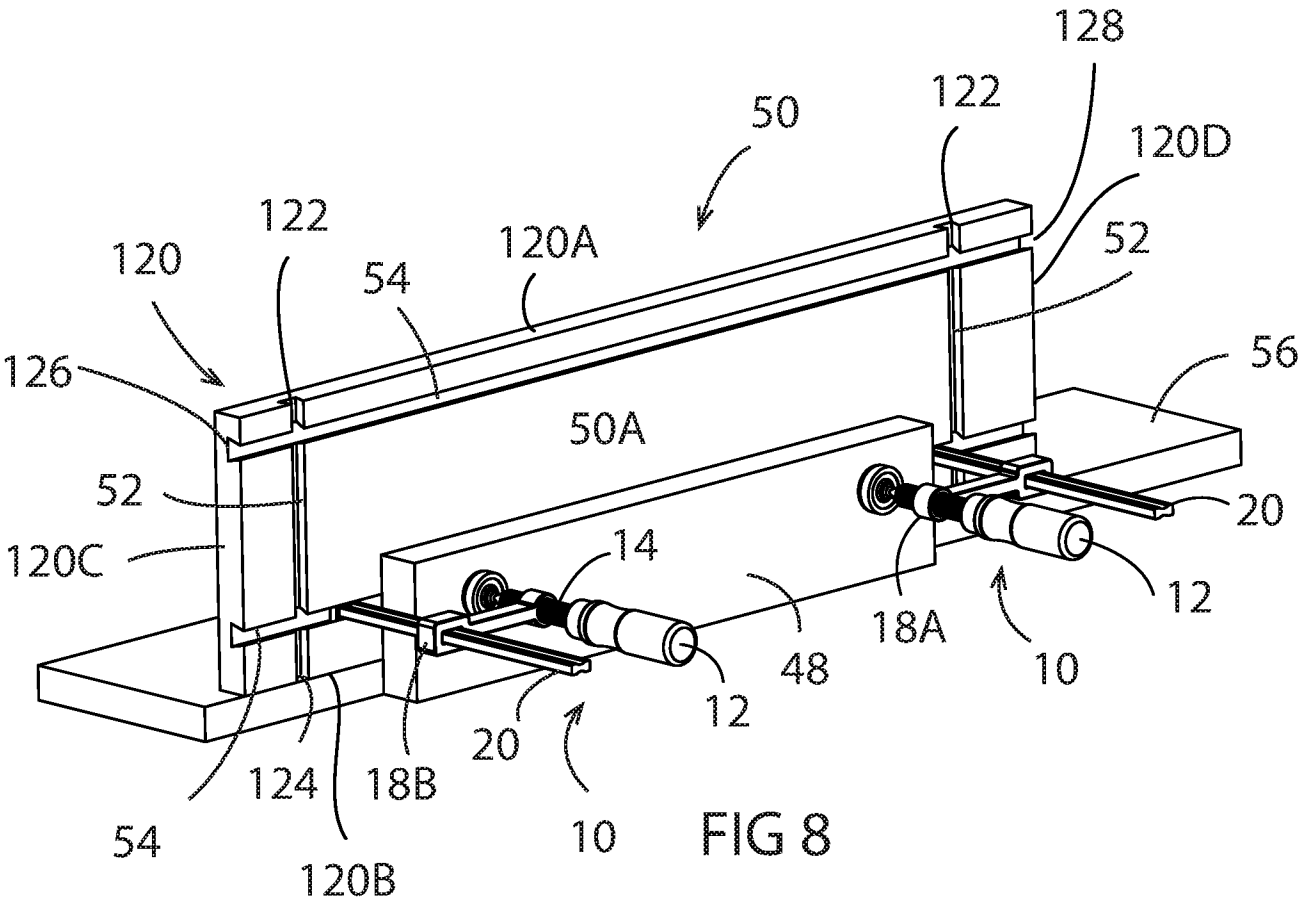
FIG. 8 is a perspective view of an auxiliary fence with horizontally and vertically disposed dovetail channels and an embodiment of the inventive clamp used to affix the auxiliary fence to the fence of a woodworking apparatus.
Figure 9:
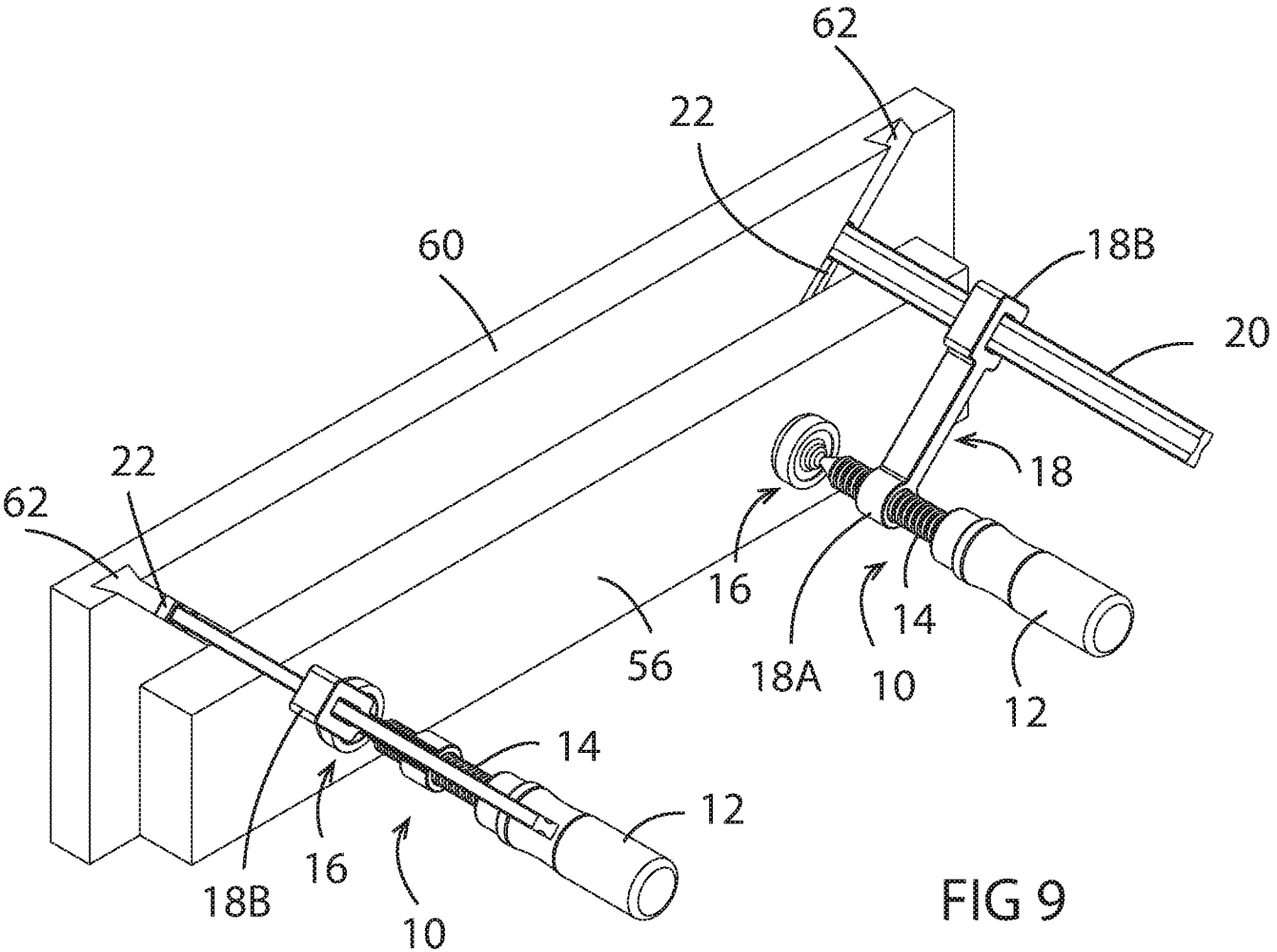
FIG. 9 is a perspective view of an auxiliary fence with diagonal dovetail channels and an embodiment of the inventive clamp used to affix the auxiliary to a fence of a woodworking cutting.

With respect to FIG. 8, the clamps 10 are shown in connection with clamping an auxiliary fence 50 on a work piece 56 both of which are longer than machine fence 48. Accordingly, the auxiliary fence 50 includes horizontally disposed dove-shaped channels 54 to access the fence 48 and auxiliary fence 50 from the sides for clamping. As shown, the auxiliary fence 50 may include vertically disposed channels 52 for use in connection with larger machine fences. As further shown in FIG. 9, the auxiliary fence 60 includes diagonally disposed channels 62, which cannot be formed in the above-described extruded metal fences. The clamps 10 are used to secure the auxiliary fence 60 to machine fence 58.

Figure 6:
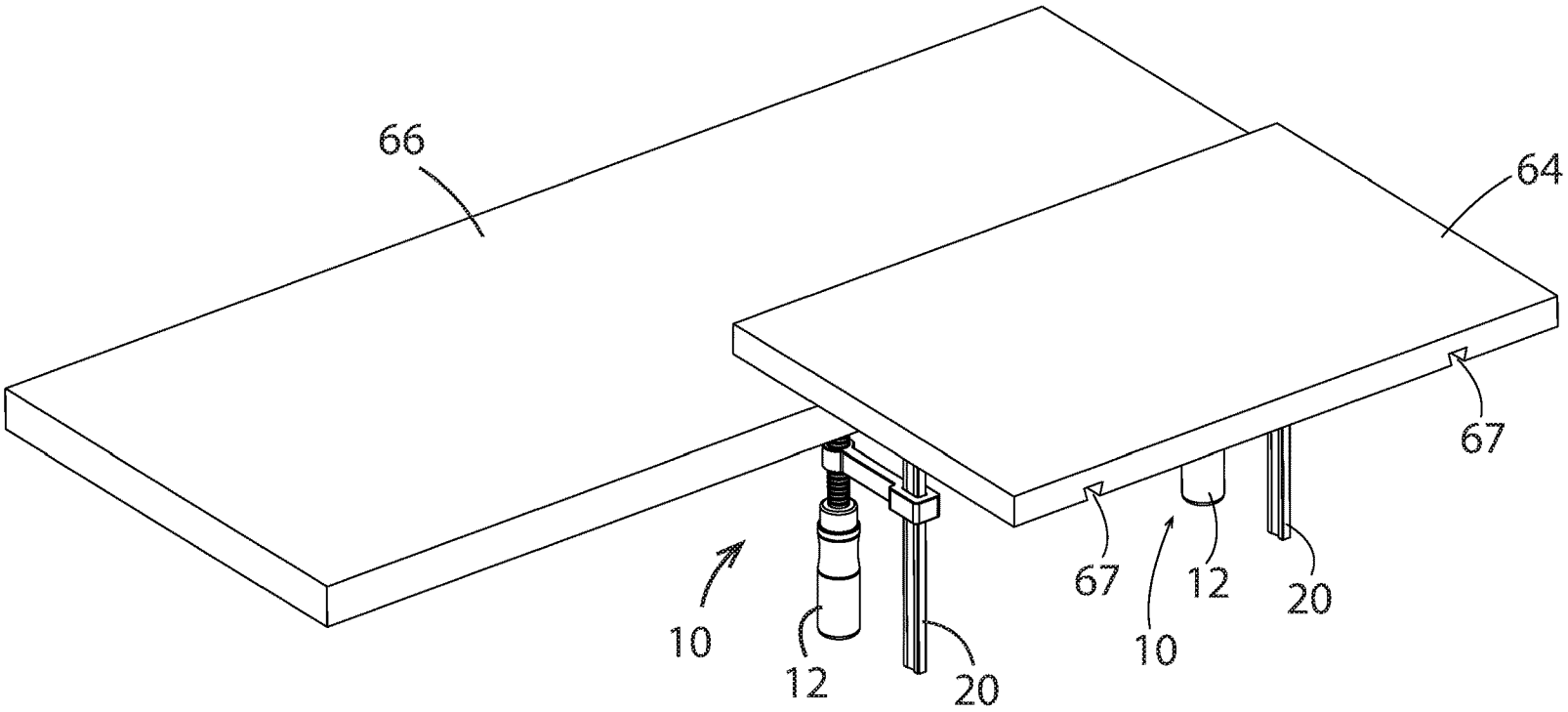
FIG. 6 is a perspective view of a wooden board affixed to a work bench using an embodiment of the inventive clamp.

In reference to FIG. 6, the clamps 10 are used to secure a wooden board 64 to a work bench 66 to provide an additional work surface. As shown, the board 64 includes dovetail shaped channels 67 in which the clamping posts 22 are inserted to clamp the board 64 to the bench 66.

Figure 10:
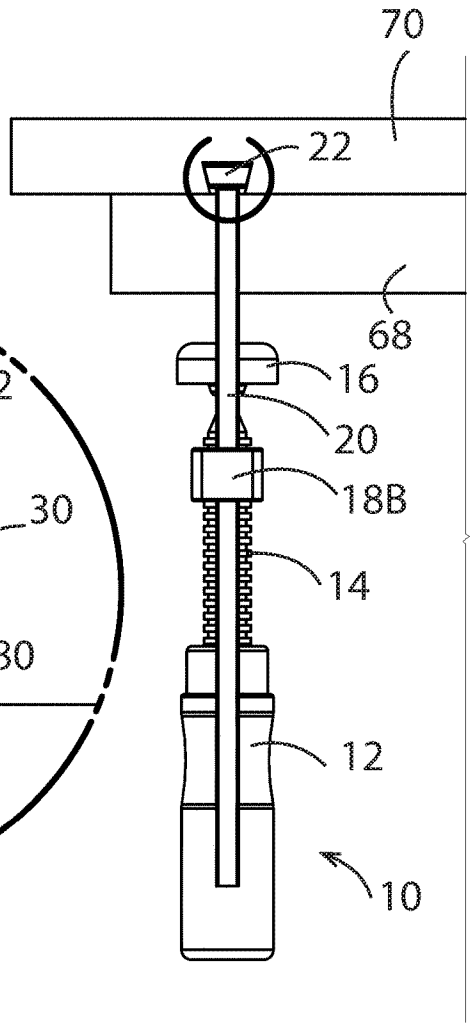
FIG. 10 is a top view of an embodiment of the inventive clamp with the clamping post inserted into a channel of an auxiliary fence, but the clamp is disengaged from a fence of a woodworking apparatus and a top view of the clamp engaged to secure an auxiliary fence to the fence of the woodworking apparatus.
Figure 10A:
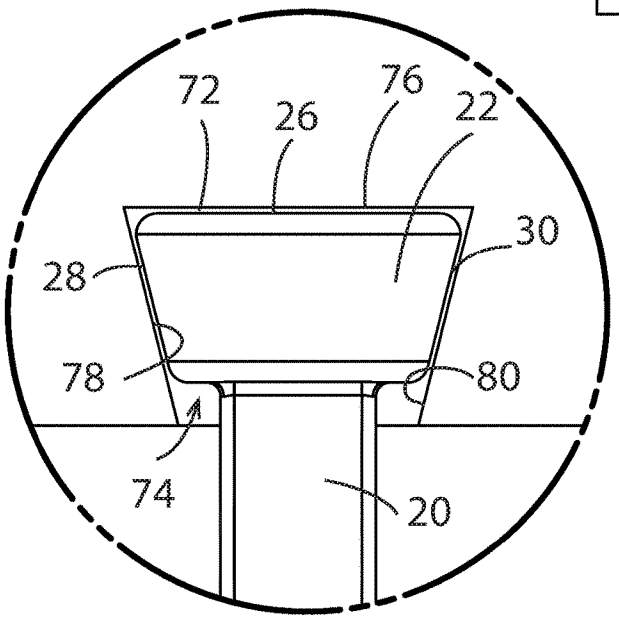
FIG. 10A is a detail view of the clamping post of FIG. 10 in the channel of the auxiliary fence.

The clamping device 10 of FIGS. 10 and 10A is shown disengaged relative to fence 68 and auxiliary fence 70. That is, the clamping post 22 has been inserted into channel 72; however, the engagement member 11 has not been moved toward the fence 68 so the clamp head 16 is not engaging the fence 68. As shown in FIG. 10A, the channel 72 includes an opening 74 spaced from a back surface 76, and inclined side surfaces 78 (first), 80 (second). With the clamping post 22 positioned toward the back surface 76 of the channel 72, the surfaces 26, 28, 30 of the clamping post 22 are spaced sufficiently from the surfaces 76, 78, 80 of the channel 72 to slide the clamping post 22 within the channel 72 to position clamping post 22 and clamp head 16 relative to the fences 68, 70 for clamping.

Figures 11, 11A:
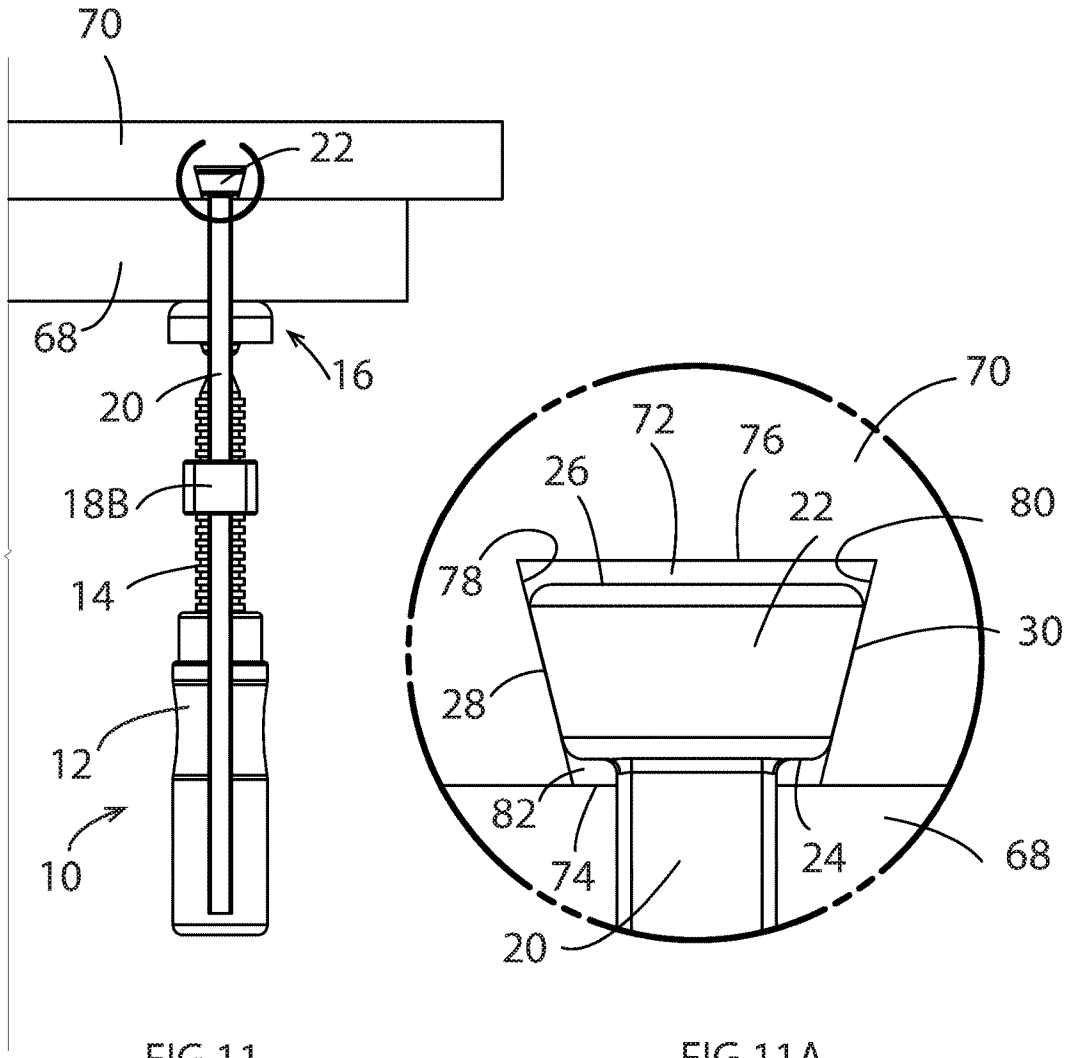
FIG. 11 is a top view of the clamp of FIG. 10 with the clamp adjusted to engage the fence of the working apparatus.
FIG. 11A is a detail view of the clamping post of FIG. 11 engaging surfaces of the channel of the auxiliary fence.

With respect to FIGS. 11 and 11A, the clamp head 16 and clamping post 22 are shown in engaged relative to fences 68, 70 respectively. As shown in FIG. 11A, when the clamp head 16 is tightened against fence 68, the clamping post 22 is pulled toward opening 74 of the channel 72, so that side surfaces 28, 30 of the clamping post 22 engage side surfaces 78, 80 of the channel 72. In as much as the clamping post 22 and channel 72 are similarly dimensioned, the clamping post 22 remains within the channel spaced from the fence 68 forming gap 82, so the edges of the opening 74 of the channel 72 are not exposed to stresses from the clamping post 22, and the fences 68, 70 are clamped flushed against one another. That is the side surfaces 28, 30 of the clamping post 22 engage the side surfaces 78, 80 of the channel 72.

Figure 12:
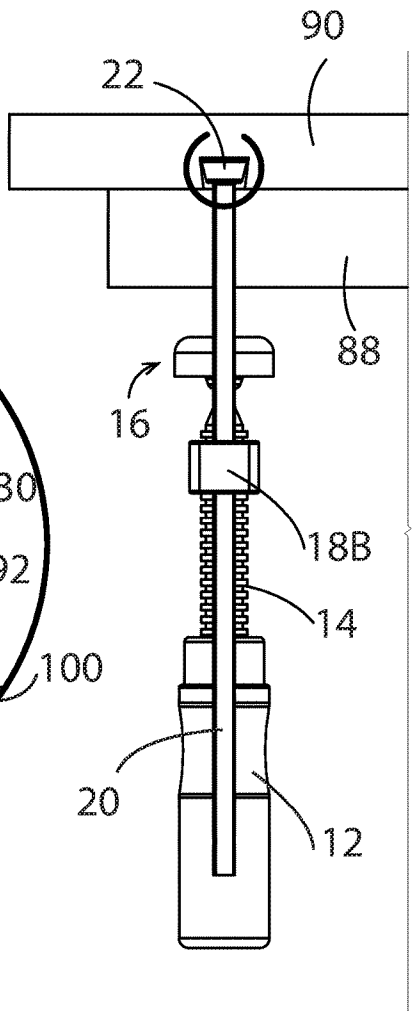
FIG. 12 is a top view of an embodiment of the inventive clamp with the clamping post inserted into a channel of an auxiliary fence, but the clamp is disengaged from a fence of a woodworking apparatus and a top view of the clamp engaged to secure an auxiliary fence to the fence of the woodworking apparatus.
Figure 12A:
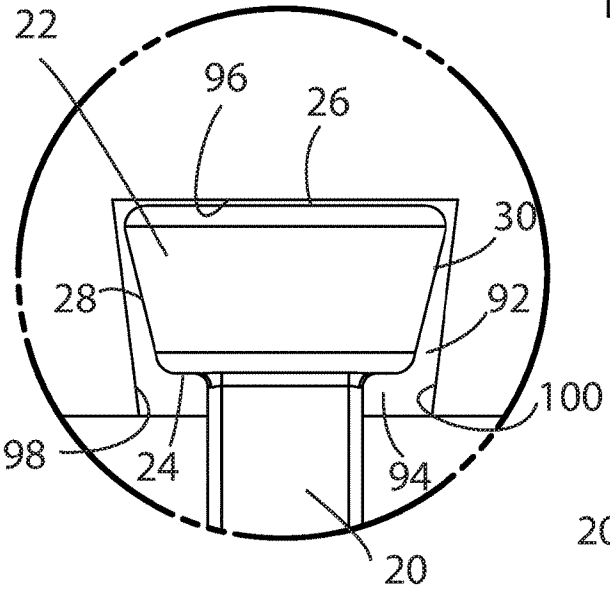
FIG. 12A is a detail view of the clamping post of FIG. 12 in the channel of the auxiliary fence, and the angled surfaces of the channel do not correspond to the shape of the clamping post.
Figures 13, 13A:
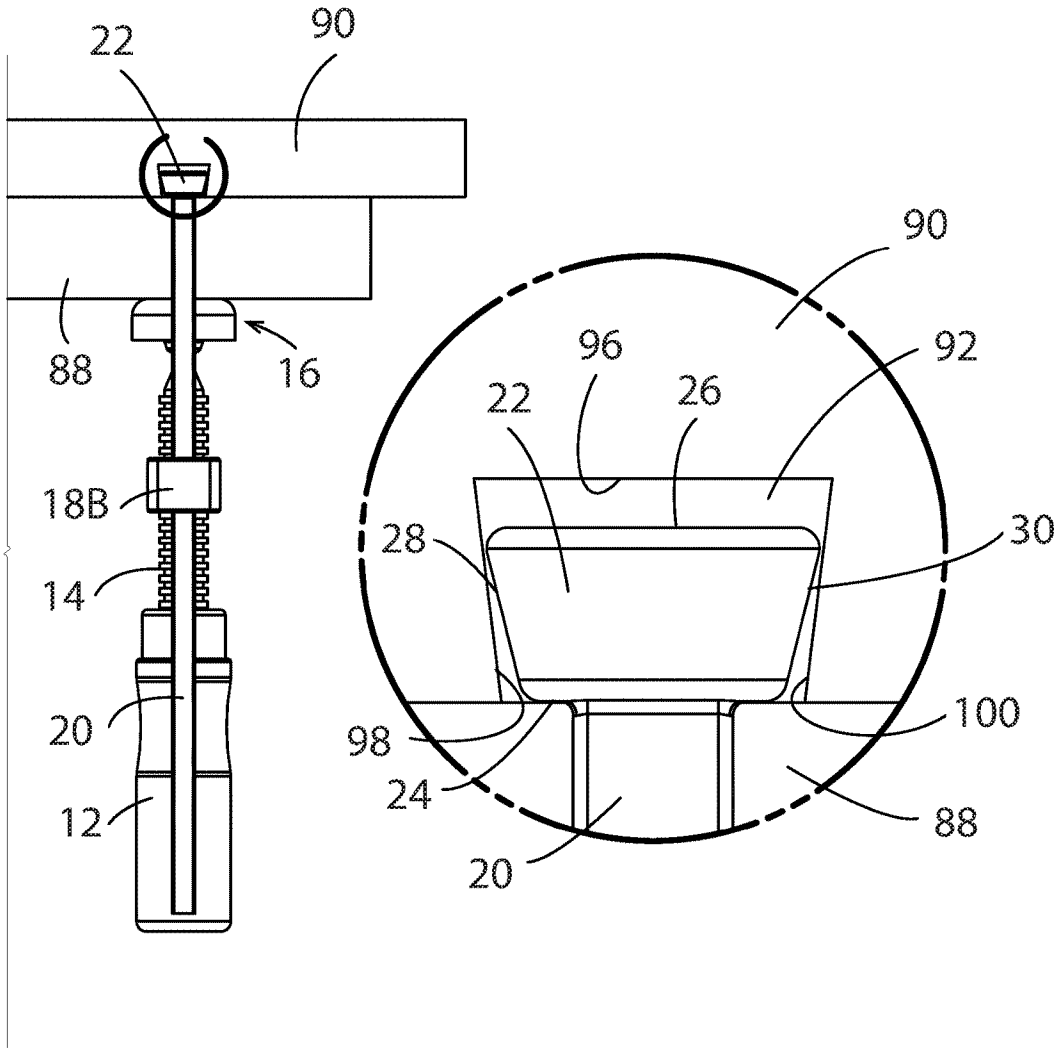
FIG. 13 is a top view of the clamp of FIG. 12 with the clamp adjusted to engage the fence of the working apparatus.
FIG. 13A is a detail view of the clamping post of FIG. 13 wherein the clamping post does not effectively engage the surfaces of the channel.

The clamping device 10 of FIGS. 12 and 12A is shown disengaged relative to fence 88 and auxiliary fence 90. That is, the clamping post 22 has been inserted into channel 92; however, the engagement member 11 has not been moved toward the fence 88 so the clamp head 16 is not engaging the fence 88. As shown in FIG. 12A, the channel 92 includes an opening 94 spaced from a back surface 96, and inclined side surfaces 98 (first), 100 (second). However, in this example the channel 92 is not properly dimensioned relative to the clamping post 22. More specifically, the angles of the side surfaces 98, 100 relative to the back surface 96 are larger than the angle of the side surfaces 28, 30 relative to the back surface 26 of the clamping post 22. With respect to FIGS. 13 and 13A, the clamp head 16 and clamping post 22 are shown in engaged at least relative to fence 88. As shown in FIG. 13B, when the clamp head 16 and clamping post 22 are engaged against the fence 88, the side surfaces 28, 30 do not properly engage the side surfaces 98, 100 of the channel 92. In this manner, the auxiliary fence 90 cannot be properly secured to the fence 88. Accordingly, the channel 92 must have dimensions corresponding to the dimensions of the clamping post as shown in FIG. 11A to effectively clamp an auxiliary fence to a fence of a woodworking apparatus. Aspects of the invention include an auxiliary woodworking component that includes a board having at least one or a plurality of dovetail shaped grooves on at least one side of the board, and the grooves are configured to receive the dovetail or trapezoid shaped second post 22 of the clamp 10. In an embodiment, the dovetail shaped grooves extend in different directions and at least some of the grooves intersect.

Figure 14:
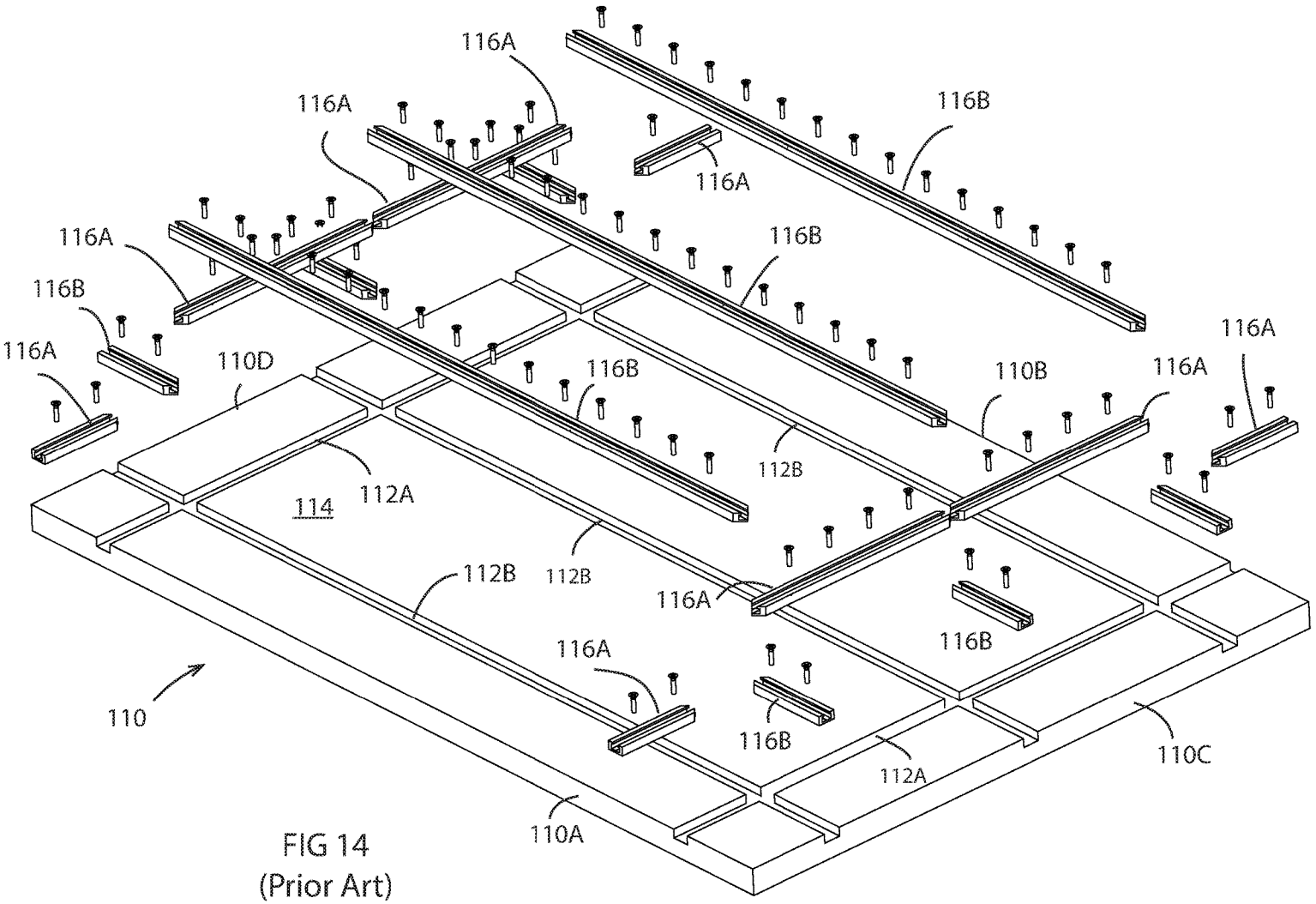
FIG 14 (Prior Art)
FIG. 14 is an exploded view of a prior art woodworking bench top with extruded aluminum tracks.
Figure 14A:
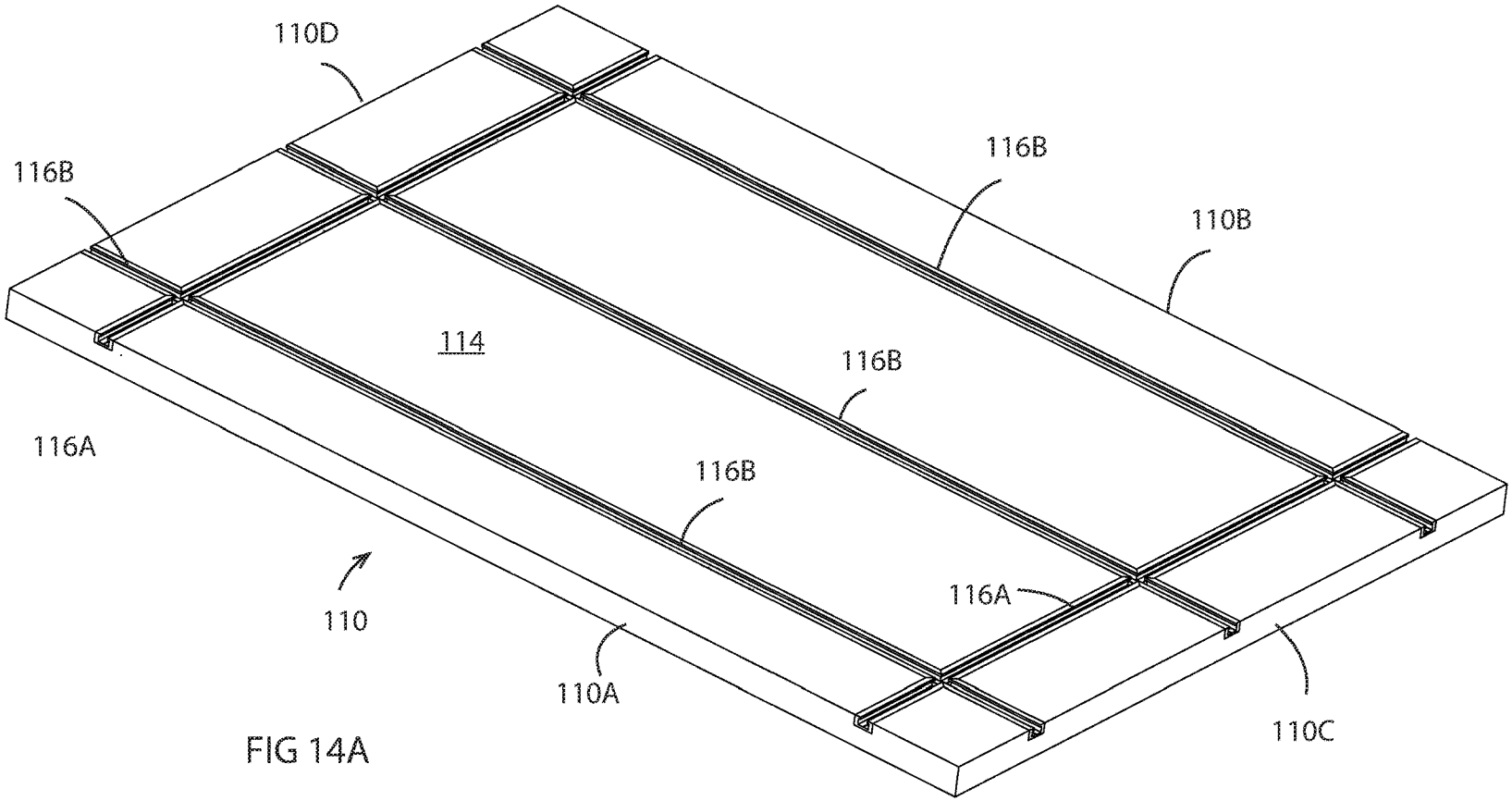
FIG. 14A is a top perspective view of the prior art woodworking bench of FIG. 14 with the extruded aluminum tracks inset thereon.
Figure 14C:
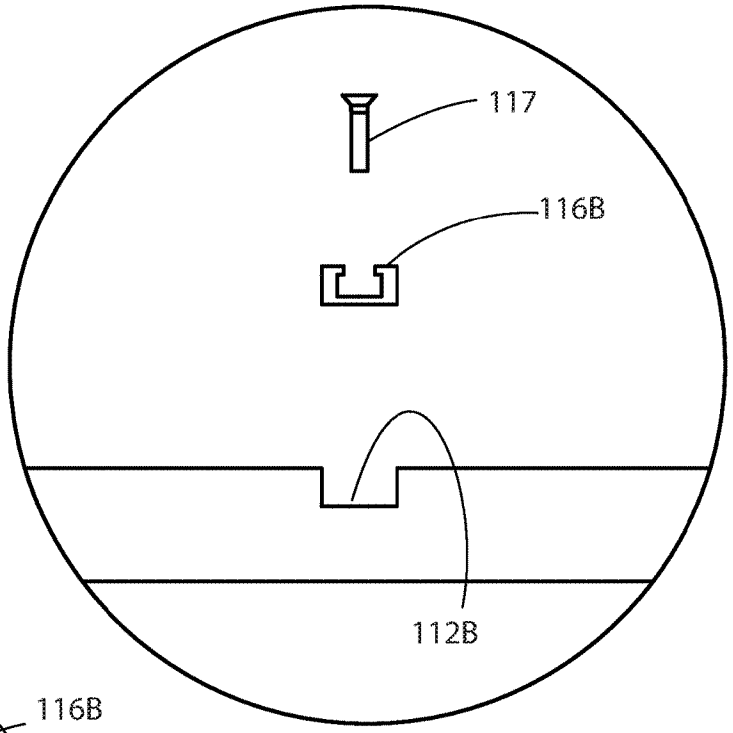
FIG. 14C is an exploded view of a groove, track and fastener assembly of prior art woodworking bench of FIG. 14.
Figure 14B:
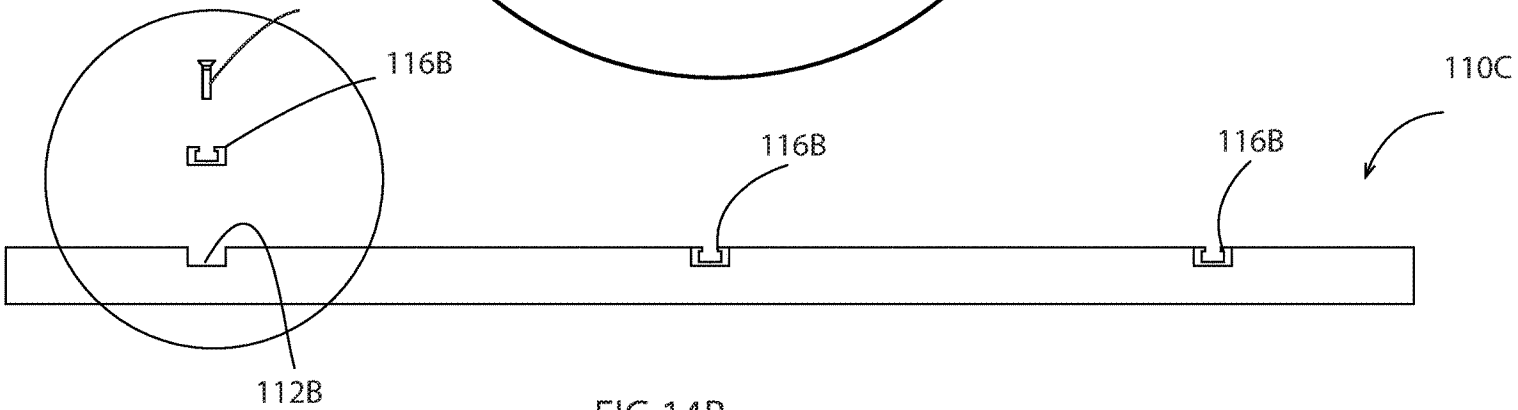
FIG. 14B is an end view of the prior art woodworking bench of FIG. 14.

A prior art auxiliary woodworking component 110 in the form of a work bench top is shown in FIGS. 14, 14A and 14B. The bench top 110 is rectangular including a first edge 110A, a second edge 110B parallel to the first edge 110A, a third edge 110C and a fourth edge 110D that is parallel to the third edge 110C.

The bench top 110 further includes a first plurality of grooves 112A that extend along a top side or first side 114 of the board from the first edge 110A to the second edge 110B of the bench top 110. A second plurality of grooves 112B extends along the first side 114 from the third edge 110C to the fourth edge 110D. Each groove 112A intersects with a groove 112B. The grooves 112A, 112B have a cross-section generally U-shaped configuration and are not capable of holding a post from a clamp. Accordingly, tracks 116A, 116B are disposed within corresponding grooves 112A, 112B and have a cross-section T-shape (FIGS. 14B and 14C) configured to receive a clamp post of a hold-down clamp, which may include an F-type clamp.

These bench tops 110 may be wooden or made of a high or medium density fiber board. The tracks 116A, 116B are extruded aluminum tracks and are fixed within grooves 112A, 112B with wood screws 117 (FIG. 14B). While these bench tops 110 work well in terms of enabling one to clamp items to the bench top 110 at a variety of different locations, the bench tops 110 are relatively expensive costing two to three hundred dollars ($200.00-$300.00).

Another shortcoming of this type of prior art woodworking component is that overtime the clamping force of a clamp tends to pull the tracks 116A, 116B outward relative to the bench top 110. This may cause the wood screws to strip the screw holes, thereby loosening the fit of a tracks 116A, 116B in grooves 112A, 112B.

Woodworking enthusiasts and professional can make their own bench tops or auxiliary components with T-shaped trackless grooves configured to receive clamp posts using corresponding shaped router bits. However, the cross-sectional dimensions of these channels are not standardized, and the end users have difficulties in cutting the properly sized grooves to receive clamping posts of a clamp. In addition, the T-shaped channels if cut too deep may compromise the structural integrity of the work surface. If cut too shallow, the T-shaped channels form thin strips of wood on the clamp side, which strips can readily break thereby compromising the attachment of the auxiliary component to a woodworking apparatus.

With respect to FIG. 8 an embodiment of an auxiliary woodworking component 50 is shown in accordance with aspects of the invention. In this embodiment the component 50 is a wooden board that is rectangular including a peripheral side edge 120 including first edge 120A that is parallel to a second edge 120B, and a third edge 120C that is parallel to a fourth edge. 120D. However, the invention for the woodworking component is not limited to a particular shape or size. For example, the board may have a circular shape, oval shape or any one of a polygon shape, such has a square, rectangle, octagon etc. Nor is it limited to a particular material such as wood. The component may be composed of any material that may be used in connection with a woodworking device such as wood, plastic, metal, wood-related materials such as medium or high density fiber board, Formica®, etc.

As further shown, the board 50 includes at least one first groove 52 that is formed in the first side and extends in a first direction on the first side 50A of the board. In this embodiment, the board 50 includes a plurality of first grooves 52. In addition, at least one second groove 54 is also formed on the first side 50A of the board 50 and extends in a second direction. Again, this embodiment includes a plurality of second grooves 54. In this embodiment, the direction of extension of the grooves 52 is perpendicular to that of the second grooves 54. To that end, each groove 52 of the first plurality of grooves intersects each groove 54 of the second plurality of grooves 54.

Each first groove 52 extends from the first edge 120A to the second edge 120B including a first opening 122 at the first edge 120A and a second opening 124 at the second edge 120B. In addition, each second groove 54 extends from the third edge 120C to the fourth edge 120D including a first opening 126 at the third edge 120C and a second opening 128 at the fourth edge 120D.

As shown in more detail in FIGS. 4, 5A, and 5B, each groove 42, 52, 54 has a cross-section dovetail or trapezoid shape configured to receive the dovetail shaped second post 22 of the clamp 10. In addition, each groove 52, 54 is trackless. That is, an additional component such as a track is not required in order for the board 50 to function as an auxiliary woodworking component for clamping. The grooves 52, 54 may be formed by a woodworking enthusiast or professional using a router and a widely used router bit. For example, the bit 32 shown in FIG. 4 may be a bit with a ½" outside diameter and 14° taper. In this manner, an individual can make his/her own auxiliary component with as many or as few of the dovetail shaped grooves as desired.

Again with respect to FIGS. 5A and 5B, the trapezoidal shape of the clamping post 22 corresponds to the dovetail shape of channels 42 so the clamping posts 22 remain within the channels 42 when the two components 38, 40 are tightened together. Moreover, forming the dovetail channels at such an angle does not create the above referenced thin strips of wood as compared to the T-shaped channels. The sides of the channels 42 provide sufficient support to the clamping posts 22, so the posts 22 remain in the channels during clamping and operation of the wood working apparatus.

While the first grooves 52 are shown intersecting the second grooves 54 the invention is not so limited. The first grooves 52 do not have to intersect the second grooves 54, or only some of the first grooves 52 may intersect the second grooves 54. In addition, the first and second grooves 52, 54 do not have to extend entirely across the board 50. That is, one or more of the first and second grooves 52, 54 may only have a single opening at the peripheral side edge 120. Moreover, the invention is not limited to the first and second grooves 52, 54 being disposed orthogonally to one another. The first and second grooves 52, 54 may be disposed at various angles relative to one another. For example some of the grooves 52, 54 may extend diagonally on the board 50.

Figure 15:
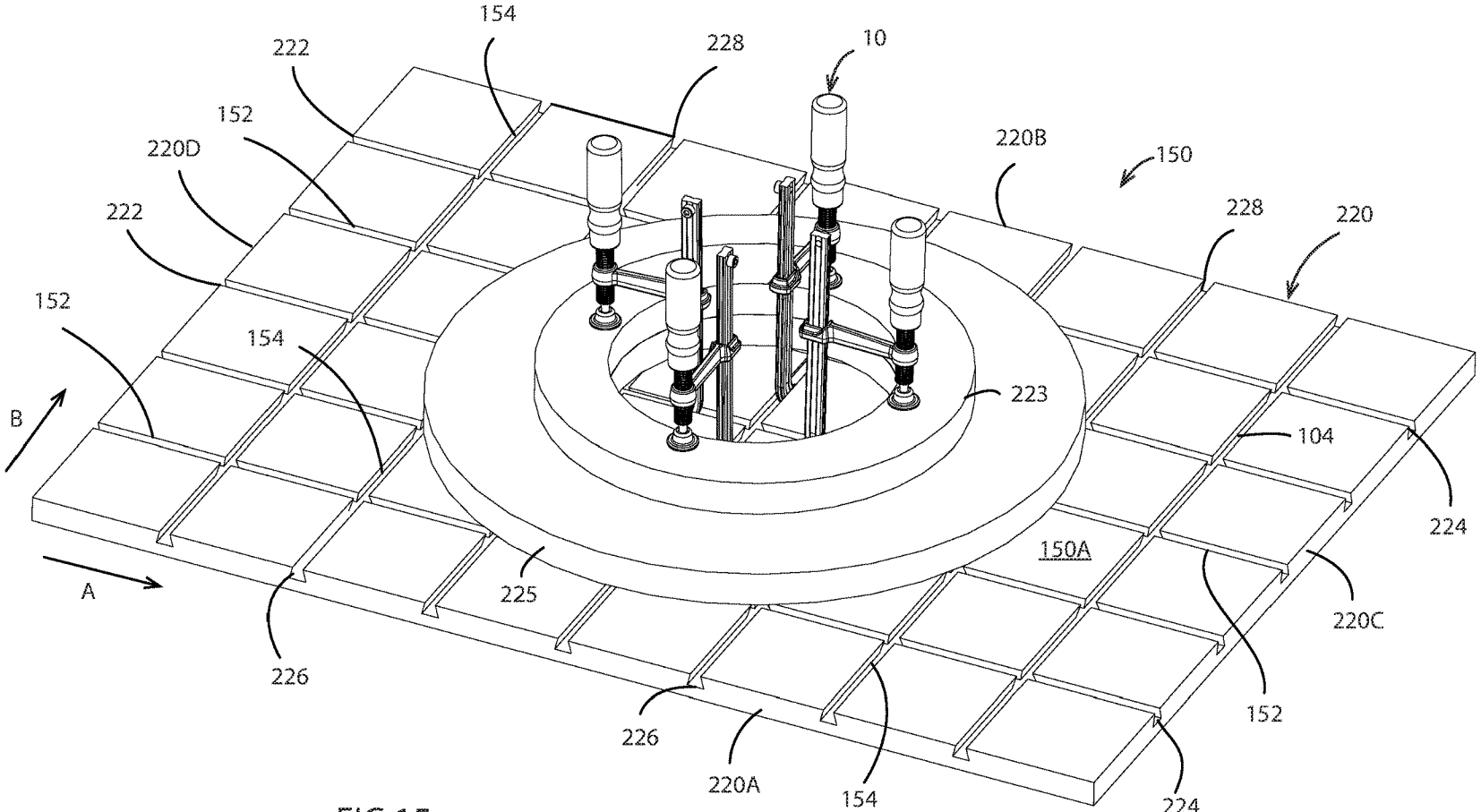
FIG. 15 is a top perspective view of an auxiliary woodworking component in accordance with aspects of the invention.
Figure 15A:
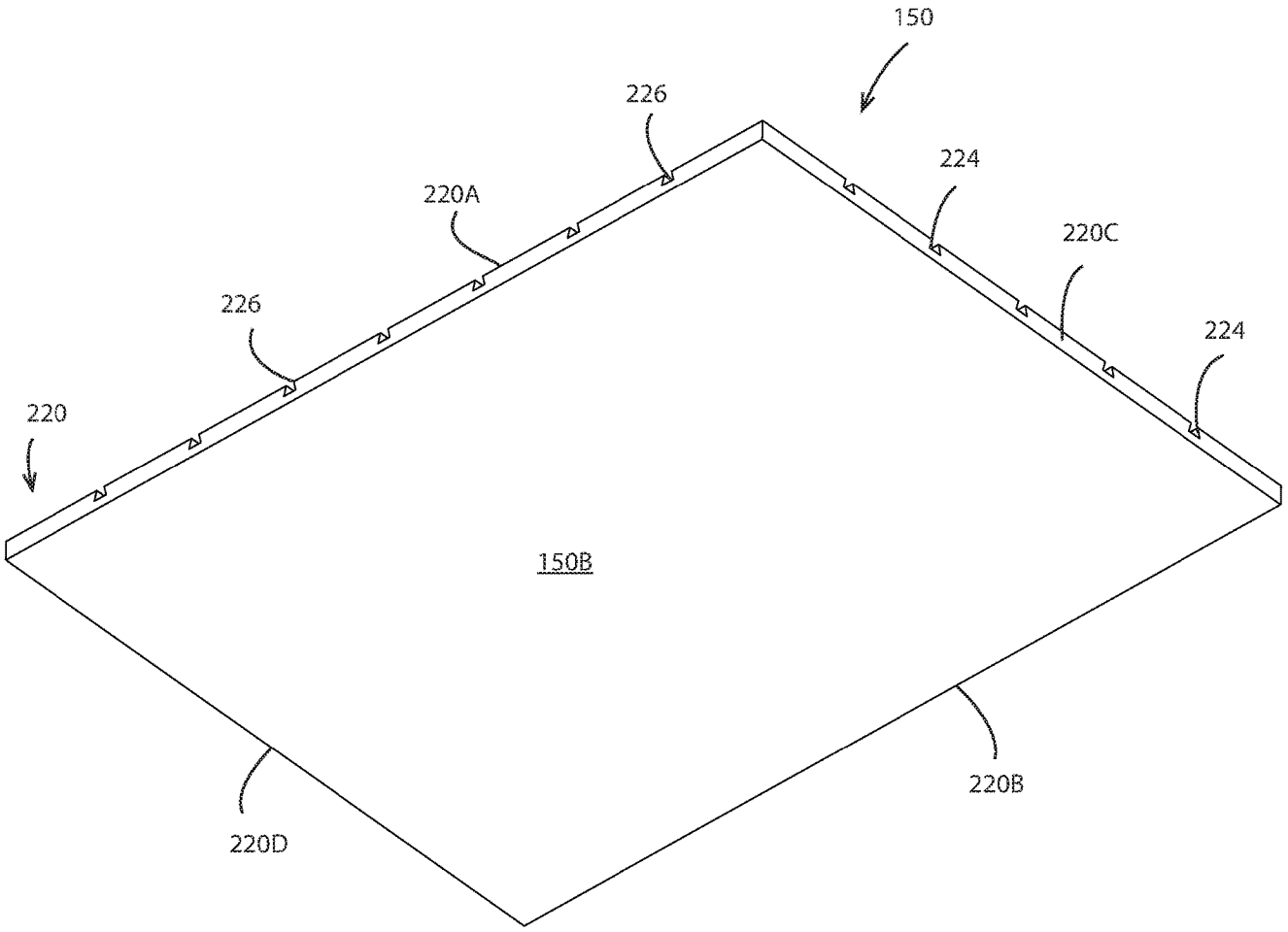
FIG. 15A is a bottom perspective view of the component of FIG. 15.

With respect to FIGS. 15 and 15A an auxiliary woodworking component or board 150 is shown including a first side 150A and a second side 150B. In this embodiment, the board 150 has a rectangular shape or outline including a peripheral side edge 220. As with the previously described in embodiment, the peripheral side edge includes a first edge 220A, second edge 220B, third edge 220C and fourth edge 220D.

A plurality of dovetail shaped first grooves 152 are disposed on the first side 150A of the component 150 and extend in a first direction represented by arrow "A." A plurality of dovetail shaped second grooves 154 extend in a second direction represented by arrow "B". As shown, the first and second grooves 152, 154 extend entirely across the first side 150A from edges 220A, 220C to edges 220B, 220D. Each first groove 152 has a first opening at side edge 220D and a second opening at side edge 220C. In addition, each second groove 154 has a first opening 226 at the side edge 220A and a second opening 228 at side edge 220B.

In addition, in an aspect of this embodiment of the invention, each of the grooves 152, 154 may be trackless.

In an aspect of the invention, each of the first grooves 152 are parallel to one another and the grooves 152 are spaced equidistance apart from one another. To that end, each of the second grooves 154 are parallel to one another and the second grooves 154 are spaced equidistance apart. In an embodiment, the spacing between consecutive first grooves 152 is the same as the spacing between consecutive second grooves 154. This equidistance spacing enables one, for example, to clamp down two parts 223, 225 together for gluing the parts 223, 225 together because the clamps 10 can be uniformly spaced relative to the parts 223, 225.

Figure 16:
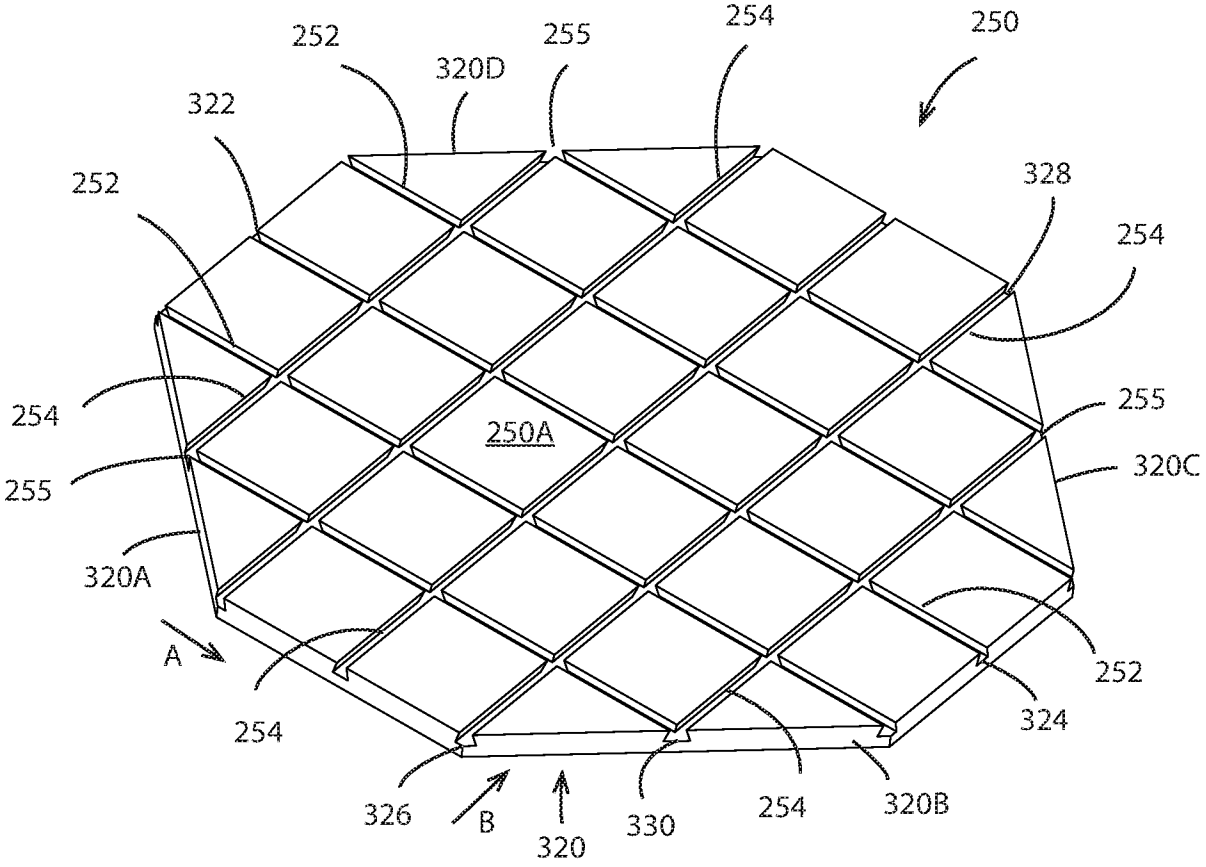
FIG. 16 is an embodiment of an auxiliary woodworking component in accordance with aspects of the invention.

With respect to FIG. 16, an in accordance with aspects of the invention, a board 250 has a peripheral side edge 320 defining a geometric shape, and in this example the shape is an octagon. A plurality of dovetail shaped first grooves 252 are disposed on the first side 250A of the component 250 and extend in a first direction represented by arrow "A." A plurality of dovetail shaped second grooves 254 extend in a second direction represented by arrow "B". As shown, the first and second grooves 252, 254 extend entirely across the first side 250A, whereby the first grooves 252 have first and second opening 322, 324, and each of the second groves 254 have first and second openings 326, 328.

In addition, in an aspect of this embodiment of the invention, each of the grooves 252, 254 may be trackless.

In as aspect of the invention, each of the first grooves 252 are parallel to one another and the grooves 252 are spaced equidistance apart from one another. To that end, each of the second grooves 254 are parallel to one another and the second grooves are spaced equidistance apart. In an embodiment, the spacing between consecutive first grooves 252 is the same as the spacing between consecutive second grooves 254. This equidistance spacing enables one, for example, to clamp down two parts 223, 225 together for gluing the parts 223, 225 together because the clamps 10 can be uniformly spaced relative to the parts 223, 225.

In this embodiment, first grooves 252 and second grooves 254 intersect at diagonal edges 320A, 320B, 320C and 320D forming an opening 330 at each respective edge 320A-320D that is in communication with a first groove 252 and 254. In this manner, access is enabled to a first groove 252 and a second groove 254 through the same opening 330.

Figure 17:
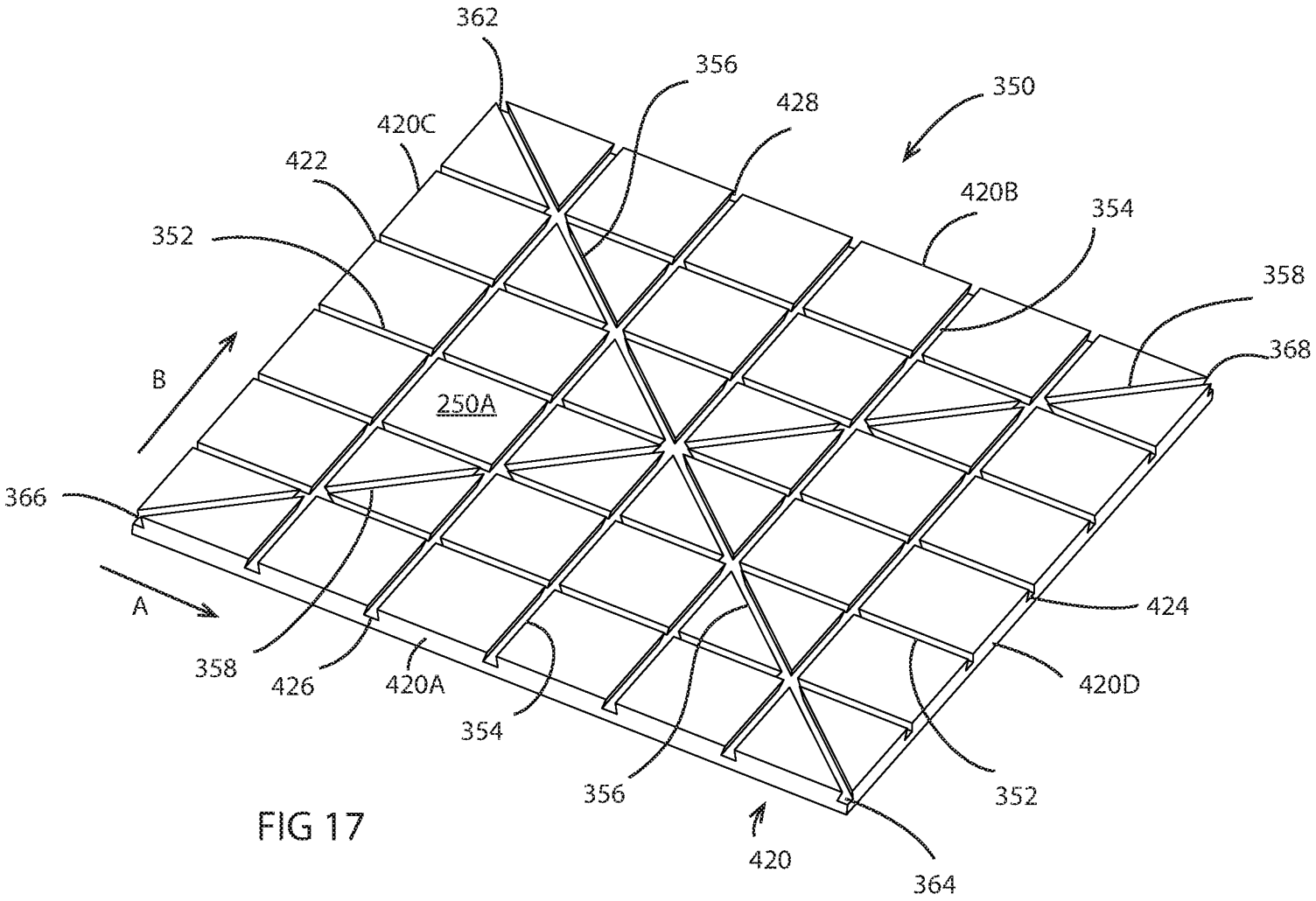
FIG. 17 is an embodiment of an auxiliary woodworking component in accordance with aspects of the invention.

With respect to FIG. 17, an in accordance with aspects of the invention, a board 350 has a peripheral side edge 420 defining a geometric shape, and in this example the shape is square, including side edges 420A, 420B, 420C, 420D. A plurality of dovetail shaped first grooves 352 are disposed on the first side 350A of the component 350 and extend in a first direction represented by arrow "A." A plurality of dovetail shaped second grooves 354 extend in a second direction represented by arrow "B". As shown, the first and second grooves 352, 354 extend entirely across the first side 350A, whereby the first grooves 352 have first and second opening 422, 424, and each of the second groves 354 have first and second openings 426, 428.

In an aspect of the invention, each of the first grooves 352 are parallel to one another and the grooves 352 are spaced equidistance apart from one another. To that end, each of the second grooves 354 are parallel to one another and the second grooves are spaced equidistance apart. In an embodiment, the spacing between consecutive first grooves 352 is the same as the spacing between consecutive second grooves 354.

In this embodiment, the board 350 also includes a first diagonal groove 356 and a second diagonal groove 358 that intersect at a center of the board 350. The first diagonal groove 356 has a first opening 362 at a corner of the board 350 and second opening 364 at an opposite corner. In addition, the second diagonal groove 358 includes a first opening 366 at a corner of the board 350 and a second opening 368 at an opposite corner.

In addition, in an aspect of this embodiment of the invention, each of the grooves 352, 354, 356 and 358 may be trackless.

While the preferred embodiments of the present invention have been shown and described herein, it will be obvious that such embodiments are provided by way of example only. Numerous variations, changes and substitutions will occur to those of skill in the art without departing from the invention herein. Non-limiting examples include a component that is described above as being attached to one part of the apparatus may alternatively be attached to a different part of the apparatus in other embodiments. Parts described as being indirectly connected may be connected directly to each other, and vice versa. Component parts may be assembled from individual pieces or may be integrally formed as a single unit. Alternative types of connectors and alternative materials may be used. The apparatus may be used with other types of power tools. Accordingly, it is intended that the invention be limited only by the spirit and scope of the appended claims.

What is claimed is:

1. An auxiliary woodworking component, comprising:

a board having a first side, a second side, and a peripheral side edge defining a shape of the board;

a first plurality of parallel dovetail shaped grooves in the first side of the board and each groove of the first plurality of grooves has an opening at the peripheral side edge;

a second plurality of parallel dovetail shaped grooves in the first side of the board, and each groove of the first plurality of grooves has an opening at the peripheral side edge; and, wherein each groove of the first plurality of grooves intersects each groove of the second plurality of grooves and each groove of the first plurality of grooves is trackless and each groove of the second plurality of grooves is trackless, wherein a cross-sectional shape of each groove of the plurality of first grooves and a cross-sectional shape of each groove of the plurality of second grooves corresponds to a cross-sectional shape of a channel cut by router bit comprising a 0.5 inch diameter and a 14 degree taper.

2. The component of claim 1, wherein the opening of each first groove is a first opening and each first groove has a second opening at the peripheral side edge of the board, and the opening of each second groove is a first opening and each second groove has a second opening at the peripheral side edge of the board.

3. The component of claim 2, wherein the peripheral side edge of the board forms a rectangle and the peripheral side edge includes a first edge that is parallel to a second edge and a third edge that is parallel to a fourth edge, and each of the first plurality of grooves extends from the first edge to the second edge of the board and each of the second plurality of grooves extends from the third edge to the fourth edge of the board and perpendicular to each of the first plurality of grooves.

4. The components of claim 1, wherein the peripheral side edge forms a circular shape, an oval shape, or a polygon shape.

5. An auxiliary woodworking component, comprising:

a board having a first side and a second side and a peripheral side edge defining a shape of the board;

at least one dovetail shaped first groove in the first side of the board and having an opening at the peripheral side edge of the board and the at least one first groove extends in a first direction;

at least one dovetail shaped second groove in the first side of the board and having an opening at the peripheral side edge of the board and the at least one second groove extends in a second direction that is different than the first direction; and, wherein the at least one dovetail shaped first groove is trackless and the at least one dovetail shaped second groove is trackless, wherein a cross-sectional shape of each groove of the at least one dovetail shaped first groove and a cross-sectional shape of each groove of the at least one dovetail shaped second groove corresponds to a cross-sectional shape of a channel cut by router bit comprising a 0.5 inch diameter and a 14 degree taper.

6. The component of claim 5, wherein the at least one first groove intersects the at least one second groove.

7. The component of claim 5, wherein the shape of the board is a circle, an oval, or a polygon.

8. The component of claim 5, wherein the opening of the at least one groove is a first opening and the at least one first groove comprises a second opening at the peripheral side edge.

9. The component of claim 5, wherein the opening of the at least one second groove is a first opening and the second at least one groove comprises a second opening at the peripheral side edge.

10. The component of claim 5, wherein the at least one first groove comprises:

a plurality of dovetail shaped first grooves in the first side of the board and each first groove of the plurality of dovetail shaped first grooves has an opening at the peripheral side edge of the board; and, the at least one second groove comprises:

a plurality of dovetail shaped second grooves in the first side of the board and each second groove of the plurality of dovetail shaped second grooves has an opening at the peripheral side edge of the board.

11. The component of claim 10, wherein each opening of each first groove is a first opening and each first groove has a second opening at the peripheral side edge of the board, and each opening of each second groove is a first opening and each second groove has a second opening at the peripheral side edge of the board, and wherein each of the first grooves intersects each of the second grooves.

12. The component of claim 10, wherein all the first grooves are parallel to each other and all the second grooves are parallel to each other.

13. The component of claim 12, wherein each first groove intersects with each second groove.

14. A multi-purpose utility clamp in combination with an auxiliary woodworking component configured to be clamped to a woodworking apparatus, comprising:

a component engagement member including a clamp head and a handle;

a guide arm operatively connected to the component engagement member at a first end of the guide arm;

a first post operatively connected to a second end of the guide arm to move linearly relative to the guide arm;

a second post at an end of the support post and disposed generally perpendicular to the first post and having a first end connected to the first post and a second end, distal the first end, and the second end is disposed opposite the clamping head;

wherein the second post has a cross-section trapezoid shape of a channel cut by a router bit comprising 0.5 inch diameter and a 14 degree taper along a length thereof between the first end and the second end, and the second post is configured to be inserted into a channel having a corresponding trapezoidal shape and formed in an auxiliary component to be clamped to another component; and, a board having a first side, a second side, and a peripheral side edge;

at least one dovetail shape groove on the first side of the board configured to receive the second post of the clamp and the at least one dovetail shaped groove is trackless, wherein a cross-sectional shape of each groove of the at least one dovetail shape groove corresponds to a cross-sectional shape of a channel cut by router bit comprising a 0.5 inch diameter and a 14 degree taper.

* * * * *